US011484756B2

(12) United States Patent
Parsons et al.

(10) Patent No.: US 11,484,756 B2
(45) Date of Patent: Nov. 1, 2022

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 17/685,566

(22) Filed: Mar. 3, 2022

(65) Prior Publication Data

US 2022/0305352 A1 Sep. 29, 2022

Related U.S. Application Data

(63) Continuation-in-part of application No. 17/389,659, filed on Jul. 30, 2021, which is a continuation of (Continued)

(51) Int. Cl.

| | |
|---|---|
| ***A63B 53/04*** | (2015.01) |
| ***A63B 60/02*** | (2015.01) |
| ***A63B 53/08*** | (2015.01) |

(52) U.S. Cl.

CPC ..... *A63B 53/0466* (2013.01); *A63B 53/04* (2013.01); *A63B 60/02* (2015.10); (Continued)

(58) Field of Classification Search

CPC ..... A63B 53/0466; A63B 53/04; A63B 60/02; A63B 2053/0491; A63B 53/0408; (Continued)

(56) References Cited

U.S. PATENT DOCUMENTS

| | | | |
|---|---|---|---|
| 1,133,129 | A | 3/1915 | Govan |
| 1,269,745 | A | 6/1918 | Robertson |

(Continued)

FOREIGN PATENT DOCUMENTS

| | | | |
|---|---|---|---|
| CN | 1572343 | A | 2/2005 |
| CN | 1608696 | A | 4/2005 |

(Continued)

OTHER PUBLICATIONS

PCT/US15/42484: International Search Report and Written Opinion dated Oct. 19,2 015 (12 Pages).

(Continued)

*Primary Examiner* — Sebastiano Passaniti

(57) ABSTRACT

Embodiments of golf club heads and methods to manufacture golf club heads are generally described herein. In one example, a golf club head may include a body portion having a bottom portion with a forward portion; a rear protrusion; a first weight port, a second weight port, and a third weight port at the forward portion; a fourth weight port at the rear protrusion; and a recessed portion separating the forward portion and rear protrusion. The recessed portion may include a plurality of contoured transition regions. An opening in the bottom portion may be defined by the rear protrusion and the plurality of contoured transition regions. A sole insert portion may be coupled to the bottom portion to cover the opening. Other examples and embodiments may be described and claimed.

20 Claims, 14 Drawing Sheets

Related U.S. Application Data application No. 16/889,524, filed on Jun. 1, 2020, now Pat. No. 11,103,755, which is a continuation of application No. 16/419,639, filed on May 22, 2019, now Pat. No. 10,695,624, which is a continuation of application No. 16/234,169, filed on Dec. 27, 2018, now Pat. No. 10,376,754, which is a continuation of application No. 16/205,583, filed on Nov. 30, 2018, now abandoned, said application No. 16/419,639 is a continuation-in-part of application No. 15/981,094, filed on May 16, 2018, now Pat. No. 10,384,102, which is a continuation of application No. 15/724,035, filed on Oct. 3, 2017, now Pat. No. 9,999,814, which is a continuation of application No. 15/440,968, filed on Feb. 23, 2017, now Pat. No. 9,795,842, said application No. 16/889,524 is a continuation-in-part of application No. 16/533,352, filed on Aug. 6, 2019, now Pat. No. 10,843,051, which is a continuation of application No. 16/030,403, filed on Jul. 9, 2018, now Pat. No. 10,413,787, application No. 17/685,566, which is a continuation-in-part of application No. 17/400,516, filed on Aug. 12, 2021, which is a continuation of application No. 16/930,716, filed on Jul. 16, 2020, now Pat. No. 11,110,328, which is a continuation of application No. 16/422,661, filed on May 24, 2019, now Pat. No. 10,722,765, application No. 17/685,566, which is a continuation-in-part of application No. 17/198,906, filed on Mar. 11, 2021, which is a continuation of application No. 16/813,453, filed on Mar. 9, 2020, now Pat. No. 10,967,231, application No. 17/685,566, which is a continuation-in-part of application No. 17/198,770, filed on Mar. 11, 2021, which is a continuation of application No. 16/807,591, filed on Mar. 3, 2020, now Pat. No. 10,960,274, application No. 17/685,566, which is a continuation-in-part of application No. 17/586,971, filed on Jan. 28, 2022, which is a continuation of application No. 17/149,954, filed on Jan. 15, 2021, now Pat. No. 11,266,888, application No. 17/685,566, which is a continuation-in-part of application No. 17/407,025, filed on Aug. 19, 2021, which is a continuation of application No. 17/225,414, filed on Apr. 8, 2021, now Pat. No. 11,117,028, application No. 17/685,566, which is a continuation-in-part of application No. 17/528,436, filed on Nov. 17, 2021.

(60) Provisional application No. 62/662,112, filed on Apr. 24, 2018, provisional application No. 62/734,176, filed on Sep. 20, 2018, provisional application No. 62/734,922, filed on Sep. 21, 2018, provisional application No. 62/740,355, filed on Oct. 2, 2018, provisional application No. 62/745,113, filed on Oct. 12, 2018, provisional application No. 62/751,456, filed on Oct. 26, 2018, provisional application No. 62/772,669, filed on Nov. 29, 2018, provisional application No. 62/621,948, filed on Jan. 25, 2018, provisional application No. 62/655,437, filed on Apr. 10, 2018, provisional application No. 62/444,671, filed on Jan. 10, 2017, provisional application No. 62/445,878, filed on Jan. 13, 2017, provisional application No. 62/530,734, filed on Jul. 10, 2017, provisional application No. 62/624,294, filed on Jan. 31, 2018, provisional application No. 62/850,292, filed on May 20, 2019, provisional application No. 62/676,860, filed on May 25, 2018, provisional application No. 62/786,371, filed on Dec. 29, 2018, provisional application No. 62/820,728, filed on Mar. 19, 2019, provisional application No. 62/816,418, filed on Mar. 11, 2019, provisional application No. 62/837,592, filed on Apr. 23, 2019, provisional application No. 62/957,757, filed on Jan. 6, 2020, provisional application No. 62/873,773, filed on Jul. 12, 2019, provisional application No. 62/897,015, filed on Sep. 6, 2019, provisional application No. 62/837,592, filed on Apr. 23, 2019, provisional application No. 62/963,430, filed on Jan. 20, 2020, provisional application No. 63/057,252, filed on Jul. 27, 2020, provisional application No. 63/010,036, filed on Apr. 14, 2020, provisional application No. 63/117,182, filed on Nov. 23, 2020, provisional application No. 63/166,859, filed on Mar. 26, 2021.

(52) U.S. Cl.
CPC ..... *A63B 53/045* (2020.08); *A63B 53/0408* (2020.08); *A63B 53/0412* (2020.08); *A63B 53/0433* (2020.08); *A63B 53/0437* (2020.08); *A63B 53/08* (2013.01); *A63B 2053/0491* (2013.01)

(58) Field of Classification Search
CPC ..... A63B 53/0412; A63B 53/0433; A63B 53/0437; A63B 53/045; A63B 53/08
USPC ..... 473/324–350, 287–292
See application file for complete search history.

(56) References Cited

U.S. PATENT DOCUMENTS

| | | | | |
|---|---|---|---|---|
| 1,306,029 | A | 6/1919 | Robertson | |
| 1,534,600 | A | 4/1925 | Mattern | |
| 1,538,312 | A | 5/1925 | Neish | |
| 3,556,533 | A | 1/1971 | Hollis | |
| 3,652,094 | A | 3/1972 | Glover | |
| 4,085,934 | A | 4/1978 | Churchward | |
| 5,106,094 | A | 4/1992 | Desbiolles et al. | |
| 5,219,408 | A | 6/1993 | Sun | |
| 5,351,958 | A | 10/1994 | Helmstetter | |
| 5,467,983 | A | 11/1995 | Chen | |
| 5,499,819 | A | 3/1996 | Nagamoto | |
| 5,518,243 | A | 5/1996 | Redman | |
| 5,624,331 | A | 4/1997 | Lo et al. | |
| 5,720,674 | A * | 2/1998 | Galy | A63B 53/0466 473/335 |
| 5,788,584 | A | 8/1998 | Parente et al. | |
| 5,971,868 | A | 10/1999 | Kosmatka | |
| 5,997,415 | A | 12/1999 | Wood | |
| 6,146,287 | A | 11/2000 | Rugge et al. | |
| 6,217,461 | B1 * | 4/2001 | Galy | A63B 60/00 473/328 |
| 6,280,349 | B1 | 8/2001 | Cook | |
| 6,306,048 | B1 | 10/2001 | McCabe et al. | |
| 6,354,962 | B1 | 3/2002 | Galloway et al. | |
| 6,368,234 | B1 | 4/2002 | Galloway | |
| 6,398,666 | B1 | 6/2002 | Evans et al. | |
| 6,409,612 | B1 | 6/2002 | Evans et al. | |
| 6,435,977 | B1 | 8/2002 | Helmstetter et al. | |
| 6,506,127 | B2 | 1/2003 | Helmstetter et al. | |
| 6,607,451 | B2 | 8/2003 | Kosmatka et al. | |
| 6,620,056 | B2 | 9/2003 | Galloway et al. | |
| 6,623,377 | B2 | 9/2003 | Evans et al. | |
| 6,638,182 | B2 | 10/2003 | Kosmatka | |
| 6,729,971 | B2 | 5/2004 | Caldwell | |
| 6,773,360 | B2 | 8/2004 | Willett et al. | |
| 6,800,040 | B2 | 10/2004 | Galloway et al. | |
| 6,811,496 | B2 | 11/2004 | Wahl et al. | |
| 6,852,038 | B2 | 2/2005 | Yabu | |
| 6,863,626 | B2 | 3/2005 | Evans et al. | |

(56) References Cited

U.S. PATENT DOCUMENTS 6,932,719 B2 8/2005 Yabu
6,969,326 B2 11/2005 Shiell et al.
6,979,270 B1 12/2005 Allen
6,986,715 B2 1/2006 Mahaffey
6,991,560 B2 1/2006 Tseng
6,997,821 B2 2/2006 Galloway et al.
7,014,570 B2 3/2006 Evans et al.
7,083,530 B2 8/2006 Wahl et al.
7,101,289 B2 9/2006 Gibbs et al.
7,125,344 B2 10/2006 Hocknell et al.
7,137,907 B2 11/2006 Gibbs et al.
7,147,757 B2 12/2006 Luyken et al.
7,153,220 B2 12/2006 Lo
7,166,040 B2 1/2007 Hoffman et al.
7,186,190 B1 3/2007 Beach et al.
7,214,142 B2 5/2007 Meyer et al.
7,223,180 B2 5/2007 Willett et al.
7,226,364 B2 6/2007 Helmstetter
7,258,625 B2 8/2007 Kawaguchi et al.
7,258,626 B2 8/2007 Gibbs et al.
7,261,646 B2 8/2007 Shiell et al.
7,281,994 B2 10/2007 Shiell et al.
7,303,486 B2 12/2007 Imamoto
7,338,388 B2 3/2008 Schweigert et al.
7,347,794 B2 3/2008 Schweigert
7,367,897 B2 5/2008 Poynor
7,407,447 B2 8/2008 Beach et al.
7,410,425 B2 8/2008 Willett et al.
7,410,426 B2 8/2008 Willett et al.
7,419,441 B2 9/2008 Hoffman et al.
7,422,528 B2 9/2008 Gibbs et al.
7,435,190 B2 10/2008 Sugimoto
7,448,960 B2 11/2008 Gibbs et al.
7,448,963 B2 11/2008 Beach et al.
7,448,964 B2 11/2008 Schweigert et al.
7,494,425 B2 2/2009 Shiell et al.
7,527,565 B1 5/2009 Ehlers et al.
7,530,904 B2 5/2009 Beach et al.
7,540,811 B2 6/2009 Beach et al.
7,568,985 B2 8/2009 Beach et al.
7,572,193 B2 8/2009 Yokota
7,575,524 B2 8/2009 Willett et al.
7,578,753 B2 8/2009 Beach et al.
7,584,531 B2 9/2009 Schweigert et al.
7,591,738 B2 9/2009 Beach et al.
7,611,424 B2 11/2009 Nagai et al.
7,621,823 B2 11/2009 Beach et al.
7,632,194 B2 12/2009 Beach et al.
7,641,568 B2 1/2010 Hoffman et al.
7,658,686 B2 2/2010 Soracco
7,713,140 B2 5/2010 Gibbs et al.
7,713,142 B2 5/2010 Hoffman et al.
7,717,804 B2 5/2010 Beach et al.
7,717,805 B2 5/2010 Beach et al.
7,731,603 B2 6/2010 Beach et al.
7,744,484 B1 6/2010 Chao
7,798,203 B2 9/2010 Schweigert et al.
7,806,781 B2 10/2010 Imamoto
7,811,178 B2 10/2010 Davis
7,846,041 B2 12/2010 Beach et al.
7,871,339 B2 1/2011 Sanchez et al.
7,927,229 B2 4/2011 Jertson et al.
7,963,861 B2 6/2011 Beach et al.
7,967,700 B2 6/2011 Stites
8,007,369 B2 8/2011 Soracco
8,012,038 B1 9/2011 Beach et al.
8,012,041 B2 9/2011 Gibbs et al.
8,016,691 B2 9/2011 Stites
8,070,623 B2 12/2011 Stites et al.
8,088,025 B2 1/2012 Wahl et al.
8,096,896 B2 1/2012 Schiell et al.
8,192,303 B2 6/2012 Ban
8,197,357 B1 6/2012 Rice et al.
8,202,175 B2 6/2012 Ban
8,216,087 B2 7/2012 Breier et al.
8,226,498 B2 7/2012 Stites et al.
8,235,843 B1 8/2012 Rice et al.
8,257,196 B1 9/2012 Abbott et al.
8,262,506 B2 9/2012 Watson et al.
8,287,402 B2 10/2012 Shiell et al.
8,353,783 B2 1/2013 Soracco
8,353,787 B2 1/2013 Meyer et al.
8,371,957 B2 2/2013 Schweigert et al.
8,376,876 B2 2/2013 Gibbs et al.
8,403,769 B2 3/2013 Stites
8,414,422 B2 4/2013 Peralta et al.
8,430,763 B2 4/2013 Beach et al.
8,444,506 B2 5/2013 Watson et al.
8,480,512 B2 7/2013 Oldknow et al.
8,485,919 B2 7/2013 Rice et al.
8,540,590 B2 9/2013 Tsukada et al.
8,562,457 B2 10/2013 Beach et al.
8,568,248 B2 10/2013 DeShiell et al.
8,602,912 B2 12/2013 Stites
8,608,587 B2 12/2013 Henrikson et al.
8,628,431 B2 1/2014 Schweigert et al.
8,651,975 B2 2/2014 Soracco
8,657,701 B2 2/2014 Boyd et al.
8,663,026 B2 3/2014 Blowers et al.
8,696,489 B2 4/2014 Gibbs et al.
8,747,253 B2 * 6/2014 Stites ..... A63B 60/02 473/345
8,777,778 B2 7/2014 Solheim et al.
8,784,232 B2 7/2014 Jertson et al.
8,790,196 B2 7/2014 Solheim et al.
8,814,724 B2 8/2014 Kato
8,814,725 B2 8/2014 Wahl et al.
8,826,512 B2 9/2014 Schweigert
8,845,454 B2 9/2014 Boyd et al.
8,858,362 B1 10/2014 Leposky et al.
8,888,607 B2 11/2014 Harbert et al.
8,900,069 B2 12/2014 Beach et al.
8,926,449 B2 1/2015 Sato
8,979,671 B1 3/2015 Demille et al.
9,033,813 B2 * 5/2015 Oldknow ..... A63B 60/02 473/344
9,089,746 B2 7/2015 Schweigert
9,101,809 B2 8/2015 Gibbs et al.
9,168,436 B2 10/2015 Slaughter et al.
9,199,140 B1 12/2015 Schweigert et al.
9,205,311 B2 * 12/2015 Stokke ..... A63B 60/02
9,242,152 B2 1/2016 Cole et al.
9,327,173 B2 5/2016 Mizutani
9,352,197 B2 5/2016 Parsons et al.
9,393,471 B2 7/2016 Beno et al.
9,399,157 B2 7/2016 Greensmith et al.
9,399,158 B2 7/2016 Parsons et al.
9,403,069 B2 8/2016 Boyd et al.
9,452,325 B2 9/2016 DeShiell et al.
9,452,327 B2 9/2016 Willett et al.
9,463,361 B2 * 10/2016 Goudarzi ..... A63B 60/54
9,550,096 B2 1/2017 Parsons et al.
9,555,294 B2 1/2017 Henrikson et al.
9,555,295 B2 1/2017 Schweigert et al.
9,630,070 B2 4/2017 Parsons et al.
9,636,554 B2 5/2017 Parsons et al.
9,662,547 B2 5/2017 Parsons et al.
9,669,270 B2 6/2017 Schweigert et al.
9,682,295 B1 6/2017 Dawson et al.
9,700,764 B2 7/2017 Carter
9,782,643 B2 10/2017 Parsons et al.
9,795,842 B1 10/2017 Parsons et al.
9,795,843 B2 10/2017 Parsons et al.
9,802,087 B2 10/2017 Schweigert et al.
9,814,945 B2 11/2017 Parsons et al.
9,814,954 B2 11/2017 Westrum et al.
9,821,200 B1 11/2017 Parsons et al.
9,821,201 B1 11/2017 Parsons et al.
9,833,667 B1 12/2017 Parsons et al.
9,839,817 B1 12/2017 Johnson et al.
9,839,821 B2 12/2017 DeShiell et al.
9,861,867 B2 1/2018 Parsons et al.
9,873,029 B1 * 1/2018 Sillies ..... A63B 60/02
9,895,582 B2 2/2018 Schweigert et al.

(56) References Cited

U.S. PATENT DOCUMENTS

| | | | | |
|---|---|---|---|---|
| 9,895,583 | B2 | 2/2018 | Parsons et al. | |
| 9,914,029 | B2 | 3/2018 | Parsons et al. | |
| 9,931,548 | B2 * | 4/2018 | Boggs | A63B 60/02 |
| 9,981,160 | B2 | 5/2018 | Parsons et al. | |
| 9,987,526 | B2 | 6/2018 | Parsons et al. | |
| 9,999,814 | B2 | 6/2018 | Parsons et al. | |
| 10,010,770 | B2 | 7/2018 | Parsons et al. | |
| 10,052,532 | B2 | 8/2018 | Parsons et al. | |
| 10,052,535 | B1 | 8/2018 | Westrum et al. | |
| 10,065,094 | B2 * | 9/2018 | Wallin | A63B 53/04 |
| 10,099,093 | B2 | 10/2018 | Parsons et al. | |
| 10,143,899 | B2 | 12/2018 | Schweigert et al. | |
| 10,173,110 | B1 * | 1/2019 | Foster | A63B 53/0466 |
| 10,213,659 | B2 | 2/2019 | Parsons et al. | |
| 10,232,234 | B2 | 3/2019 | Parsons et al. | |
| 10,252,123 | B2 | 4/2019 | Parsons et al. | |
| 10,293,220 | B2 | 5/2019 | Schweigert et al. | |
| 10,293,221 | B2 | 5/2019 | Parsons et al. | |
| 10,328,319 | B2 | 6/2019 | Nakamura | |
| 10,335,645 | B2 | 7/2019 | Parsons et al. | |
| 10,376,754 | B2 | 8/2019 | Parsons et al. | |
| 10,384,102 | B2 | 8/2019 | Parsons et al. | |
| 10,413,787 | B2 | 9/2019 | Parsons et al. | |
| 10,420,989 | B2 | 9/2019 | Parsons et al. | |
| 10,420,990 | B2 | 9/2019 | Parsons et al. | |
| 10,441,855 | B2 | 10/2019 | Parsons et al. | |
| 10,532,257 | B2 | 1/2020 | Schweigert et al. | |
| 10,543,407 | B2 | 1/2020 | Parsons et al. | |
| 10,583,336 | B2 | 3/2020 | Parsons et al. | |
| 10,617,917 | B2 | 4/2020 | Parsons et al. | |
| 10,617,918 | B2 | 4/2020 | Parsons et al. | |
| 10,653,928 | B2 | 5/2020 | Parsons et al. | |
| 10,695,623 | B2 | 6/2020 | Parsons et al. | |
| 10,695,624 | B2 | 6/2020 | Parsons et al. | |
| 10,709,942 | B2 | 7/2020 | Parsons et al. | |
| 10,722,764 | B2 | 7/2020 | Parsons et al. | |
| 10,722,765 | B2 | 7/2020 | Schweigert et al. | |
| 10,773,135 | B1 * | 9/2020 | Hoffman | A63B 53/00 |
| 10,786,712 | B2 | 9/2020 | Parsons et al. | |
| 10,821,334 | B2 | 11/2020 | Schweigert et al. | |
| 10,843,051 | B2 | 11/2020 | Parsons et al. | |
| 10,898,766 | B2 | 1/2021 | Parsons et al. | |
| 10,898,768 | B2 | 1/2021 | Parsons et al. | |
| 10,926,142 | B2 | 2/2021 | Parsons et al. | |
| 10,960,274 | B2 | 3/2021 | Parsons et al. | |
| 10,960,275 | B2 | 3/2021 | Parsons et al. | |
| 10,967,231 | B2 | 4/2021 | Parsons et al. | |
| 11,013,966 | B2 * | 5/2021 | Cleghorn | A63B 53/06 |
| 11,090,536 | B2 * | 8/2021 | Bennett | A63B 53/06 |
| 11,117,027 | B2 * | 9/2021 | Hoffman | A63B 53/0466 |
| D941,412 | S * | 1/2022 | Parsons | D21/752 |
| D954,877 | S * | 6/2022 | Parsons | D21/752 |
| D954,878 | S * | 6/2022 | Parsons | D21/752 |
| D954,879 | S * | 6/2022 | Parsons | D21/752 |
| 2002/0019265 | A1 | 2/2002 | Allen | |
| 2002/0028714 | A1 | 3/2002 | Kosmatka | |
| 2003/0027662 | A1 | 2/2003 | Werner et al. | |
| 2003/0148818 | A1 | 8/2003 | Myrhum et al. | |
| 2003/0199335 | A1 | 10/2003 | Bissonnette et al. | |
| 2004/0087388 | A1 | 5/2004 | Beach et al. | |
| 2004/0192468 | A1 | 9/2004 | Onoda et al. | |
| 2005/0096154 | A1 | 5/2005 | Chen | |
| 2005/0209021 | A1 | 9/2005 | Hoffman et al. | |
| 2005/0250596 | A1 | 11/2005 | Chuang | |
| 2006/0052181 | A1 | 3/2006 | Serrano et al. | |
| 2006/0100031 | A1 | 5/2006 | Lan | |
| 2006/0194644 | A1 | 8/2006 | Nishio | |
| 2007/0129161 | A1 | 6/2007 | Matsunaga et al. | |
| 2008/0004129 | A1 | 1/2008 | Lin et al. | |
| 2008/0004133 | A1 | 1/2008 | Schweigert | |
| 2008/0248896 | A1 | 10/2008 | Hirano | |
| 2008/0261715 | A1 * | 10/2008 | Carter | A63B 53/06 473/335 |
| 2009/0029795 | A1 | 1/2009 | Schweigert et al. | |
| 2009/0264218 | A1 | 10/2009 | Willett et al. | |
| 2010/0144461 | A1 | 6/2010 | Ban | |
| 2010/0323812 | A1 | 12/2010 | Boyd et al. | |
| 2010/0331102 | A1 | 12/2010 | Golden et al. | |
| 2012/0021849 | A1 | 1/2012 | Gibbs et al. | |
| 2012/0064994 | A1 | 3/2012 | Wada et al. | |
| 2014/0248976 | A1 * | 9/2014 | Stokke | A63B 53/06 473/335 |
| 2015/0094166 | A1 * | 4/2015 | Taylor | A63B 53/0433 473/335 |
| 2015/0126305 | A1 | 5/2015 | Stokke et al. | |
| 2015/0231458 | A1 | 8/2015 | Petersen et al. | |
| 2015/0290503 | A1 | 10/2015 | Su | |
| 2016/0038799 | A1 | 2/2016 | Cruz et al. | |
| 2017/0007892 | A1 | 1/2017 | Schweigert et al. | |
| 2018/0296887 | A1 | 10/2018 | Motokawa | |
| 2021/0260447 | A1 * | 8/2021 | Penney | A63B 53/04 |

FOREIGN PATENT DOCUMENTS

| | | | |
|---|---|---|---|
| CN | 203108126 | U | 8/2013 |
| JP | H0241003 | U | 3/1990 |
| JP | 2002535056 | A | 10/2002 |
| JP | 2005287679 | A | 10/2005 |
| JP | 2006223331 | A | 8/2006 |
| JP | 2007136068 | A | 6/2007 |
| JP | 2008161597 | A | 7/2008 |
| JP | 3158662 | U | 4/2010 |
| JP | 2010069106 | A | 4/2010 |

OTHER PUBLICATIONS

PCT/US16/17474: International Search Report and Written Opinion dated May 12, 2016 (9 Pages).

PCT/US17/28402: International Search Report and Written Opinion dated Jul. 18, 2017 (10 Pages).

PCT/US17/55155: International Search Report and Written Opinion dated Jan. 25, 2018 (9 Pages).

PCT/US19/17464: International Search Report and Written Opinion dated Apr. 29, 2019 (9 Pages).

PCT/US19/54104: International Search Report and Written Opinion dated Dec. 30, 2019 (10 Pages).

PCT/US2015/042282: International Search Report and Written Opinion dated Oct. 13, 2 015 (12 Pages).

PCT/US2017/013513: International Search Report and Written Opinion dated Mar. 17, 2017 (18 Pages).

PCT/US2019/026099: International Search Report and Written Opinion dated May 7, 2019 (7 pages).

PCT/US2020/021869: International Search Report and Written Opinion dated May 14, 2020 (12 Pages).

Spotted: Three New PXG Drivers Appear on the USGA Conforming List (GOLFWRX). Dec. 18, 2017. Retrieved From the Internet on Jan. 16, 2019. URL:. http:/Avww.golfwrx.com/482592/spotted-three-new-pxg-drivers-appear-on-the-usga-conforming-list/ 3/12.

* cited by examiner

GOLF CLUB HEADS AND METHODS TO MANUFACTURE GOLF CLUB HEADS

CROSS REFERENCE

This application is a continuation-in-part of application Ser. No. 17/389,659, filed Jul. 30, 2021, which is a continuation of application Ser. No. 16/889,524, filed Jun. 1, 2020, now U.S. Pat. No. 11,103,755, which is a continuation of application Ser. No. 16/419,639, filed May 22, 2019, now U.S. Pat. No. 10,695,624, which is a continuation of application Ser. No. 16/234,169, filed Dec. 27, 2018, now U.S. Pat. No. 10,376,754, which is a continuation of application Ser. No. 16/205,583, filed Nov. 30, 2018, now abandoned, which claims the benefit of U.S. Provisional Application No. 62/662,112, filed Apr. 24, 2018, U.S. Provisional Application No. 62/734,176, filed Sep. 20, 2018, U.S. Provisional Application No. 62/734,922, filed Sep. 21, 2018, U.S. Provisional Application No. 62/740,355, filed Oct. 2, 2018, U.S. Provisional Application No. 62/745,113, filed Oct. 12, 2018, U.S. Provisional Application No. 62/751,456, filed Oct. 26, 2018, U.S. Provisional Application No. 62/772,669, filed Nov. 29, 2018.

U.S. application Ser. No. 16/234,169, filed Dec. 27, 2018, now U.S. Pat. No. 10,376,754, also claims the benefit of U.S. Provisional Application No. 62/621,948, filed Jan. 25, 2018, and U.S. Provisional Application No. 62/655,437, filed Apr. 10, 2018.

U.S. application Ser. No. 16/419,639, filed May 22, 2019, now U.S. Pat. No. 10,695,624, is a continuation-in-part of application Ser. No. 15/981,094, filed May 16, 2018, now U.S. Pat. No. 10,384,102, which is a continuation of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. application Ser. No. 16/889,524 is a continuation-in-part of application Ser. No. 16/533,352, filed Aug. 6, 2019, now U.S. Pat. No. 10,843,051, which is a continuation of application Ser. No. 16/030,403, filed Jul. 9, 2018, now U.S. Pat. No. 10,413,787, which claims the benefit of U.S. Provisional Application No. 62/530,734, filed Jul. 10, 2017, and U.S. Provisional Application No. 62/624,294, filed Jan. 31, 2018.

This application is a continuation-in-part of application Ser. No. 17/400,516, filed Aug. 12, 2021, which is a continuation of application Ser. No. 16/930,716, filed Jul. 16, 2020, now U.S. Pat. No. 11,110,328, which is a continuation of application Ser. No. 16/422,661, filed May 24, 2019, now U.S. Pat. No. 10,722,765, which claims the benefit of U.S. Provisional Application No. 62/850,292, filed May 20, 2019, U.S. Provisional Application No. 62/676,860, filed May 25, 2018, U.S. Provisional Application No. 62,786,371, filed Dec. 29, 2018, U.S. Provisional Application No. 62/820,728, filed Mar. 19, 2019, U.S. Provisional Application No. 62/816,418, filed Mar. 11, 2019, and U.S. Provisional Application No. 62/837,592, filed Apr. 23, 2019.

This application is a continuation-in-part of application Ser. No. 17/198,906, filed Mar. 11, 2021, which is a continuation of application Ser. No. 16/813,453, filed Mar. 9, 2020, now U.S. Pat. No. 10,967,231, which claims the benefit of U.S. Provisional Application No. 62/816,418, filed Mar. 11, 2019, U.S. Provisional Application No. 62/957,757, filed Jan. 6, 2020, U.S. Provisional Application No. 62/837,592, filed Apr. 23, 2019, U.S. Provisional Application No. 62/873,773, filed Jul. 12, 2019, and U.S. Provisional Application No. 62/897,015, filed Sep. 6, 2019.

This application is a continuation-in-part of application Ser. No. 17/198,770, filed Mar. 11, 2021, which is a continuation of application Ser. No. 16/807,591, filed Mar. 3, 2020, now U.S. Pat. No. 10,960,274, which claims the benefit of U.S. Provisional Application No. 62/837,592, filed Apr. 23, 2019, U.S. Provisional Application No. 62/873,773, filed Jul. 12, 2019, U.S. Provisional Application No. 62/897,015, filed Sep. 6, 2019, U.S. Provisional Application No. 62/820,728, filed Mar. 19, 2019, U.S. Provisional Application No. 62/816,418, filed Mar. 11, 2019, and U.S. Provisional Application No. 62/957,757, filed Jan. 6, 2020.

This application is a continuation-in-part of application Ser. No. 17/586,971, filed Jan. 28, 2022, which is a continuation of application Ser. No. 17/149,954, filed Jan. 15, 2021, now U.S. Pat. No. 11,266,888, which claims the benefit of U.S. Provisional Application No. 62/963,430, filed Jan. 20, 2020.

This application is a continuation-in-part of application Ser. No. 17/407,025, filed Aug. 19, 2021, which is a continuation of application Ser. No. 17/225,414, filed Apr. 8, 2021, now U.S. Pat. No. 11,117,028, which claims the benefit of U.S. Provisional Application No. 63/057,252, filed Jul. 27, 2020, and claims the benefit of U.S. Provisional Application No. 63/010,036, filed Apr. 14, 2020.

This application is a continuation-in-part of application Ser. No. 17/528,436, filed Nov. 17, 2021, which claims the benefit of U.S. Provisional Application No. 63/117,182, filed Nov. 23, 2020.

This application claims the benefit of U.S. Provisional Application No. 63/166,859, filed Apr. 26, 2021.

The disclosures of the above listed applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
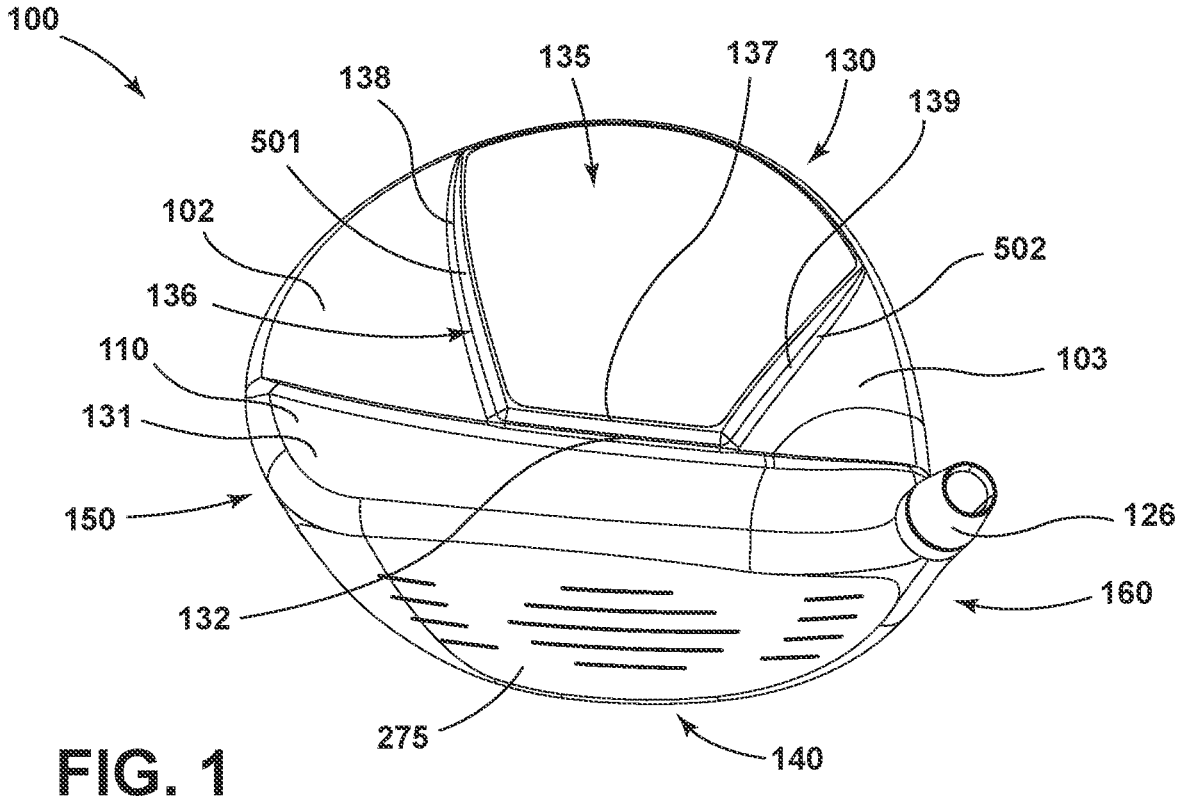
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

The following U.S. Patents and Patent Publications, which are collectively referred to herein as "the incorporated by reference applications," are incorporated by reference herein in their entirety: U.S. Pat. Nos. 9,199,140, 9,352,197, 9,399,158, 9,550,096, 9,555,295, 9,143,0070, 9,636,554, 9,662,547, 9,614,9270, 9,782,643, 9,795,842, 9,795,843, 9,802,087, 9,814,945, 9,821,200, 9,821,201, 9,833,667, 9,861,867, 9,895,582, 9,895,583, 9,914,029, 9,981,160, 9,987,526, 9,999,814, 10,010,770, 10,052,532, 10,099,093, 10,143,899, 10,195,101, 10,213,659, 10,232,234, 10,252,123, 10,293,220, 10,293,221, 10,335,1445, 10,315,14754, 10,384,102, 10,413,787, 10,420,989, 10,420,990, 10,441,855, 10,532,257, 10,543,407, 10,583,336, 10,617,917, 10,617,918, 10,653,928, 10,695,623, 10,695,624, 10,709,942, 10,152,2764, 10,152,2765, 10,786,1512, 10,821,334, 10,843,051, 10,898,766, 10,898,768, 10,926,142, 10,960,274, 10,960,275, 10,961,5231, 10,981,037, 11,000,1542, 11,103,755, 11,110,328, 11,111,5028, and 11,115,3356; and U.S. Patent Publication Numbers 20200206589, 20210121747, 20210128996, 20210138320, 202101915039, 202101915040, 20210205673, 20210228949, 20210354009, 202103150145, 20210379453, and 20220040542.

In general, golf club heads and methods to manufacture golf club heads are described herein. The apparatus, methods, and articles of manufacture described herein are not limited in this regard. In the example of FIGS. 1-13, a golf club head 100 may include a body portion 110 with a top portion 130, a crown portion 135, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. Alternatively, the golf club head 100 may not include the skirt portion 190. The front portion 170 may include a face portion 275 to engage a golf ball. The face portion 275 may be integral to the body portion 110 or may be a separate face portion that is coupled (e.g., welded) to the front portion 170 to enclose an opening in the front portion 170. The body portion 110 may also include a hosel portion configured to receive a shaft portion (not shown). The hosel portion may be similar in many respects to any of the hosel portions described herein. The hosel portion may include an interchangeable hosel sleeve 126 and a fastener 127. Alternatively, the body portion 110 may include a bore instead of the hosel portion. The body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material. The apparatus, methods, and articles of manufacture described herein are not limited in this regard.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Figure 8:
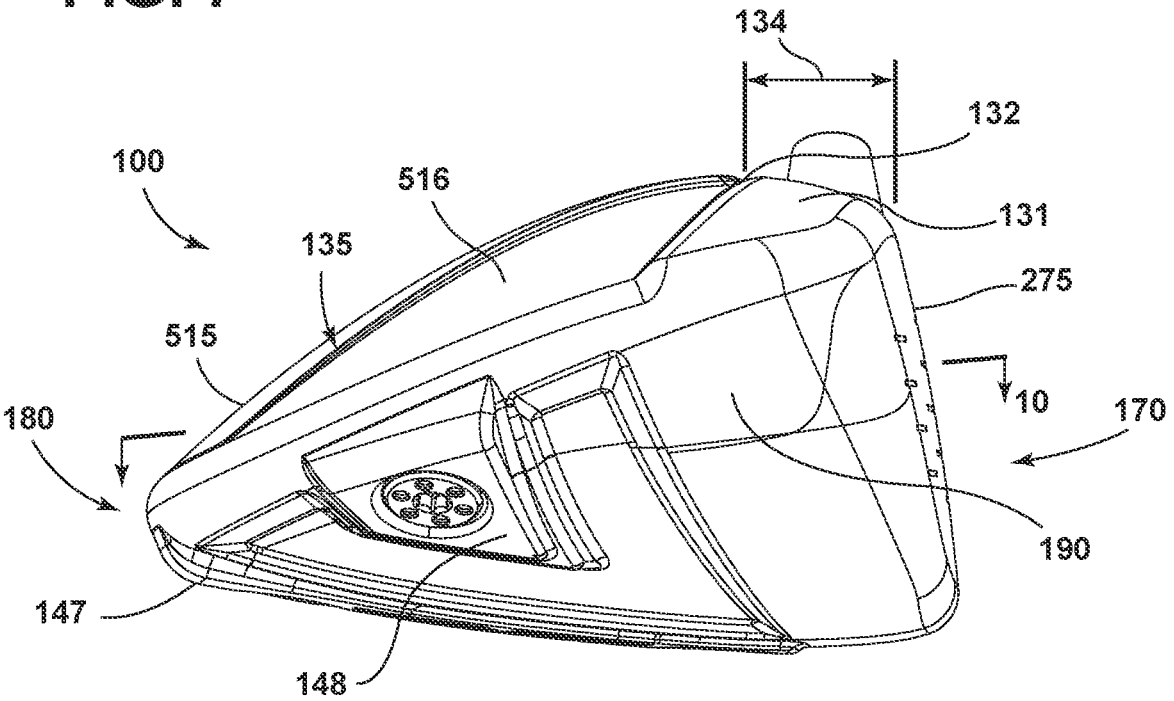
FIG. 8 is a toe side view of the golf club head of FIG. 1.

The top portion 130 may include a forward portion 131 extending a distance 134 between the front portion 170 and the crown portion 135, as shown in FIG. 8. In one example, the forward portion 131 may extend a distance 134 of at least 8 mm in a front-to-rear direction, resulting in the crown portion 135 being positioned at least 8 mm rearward of the face portion 275. In another example, the forward portion 131 may extend a distance 134 of at least 12 mm in a front-to-rear direction. In another example, the forward portion 131 may extend a distance 134 of at least 16 mm in a front-to-rear direction. In yet another example, the forward portion 131 may extend a distance 134 of at least 20 mm in a front-to-rear direction. In still another example, the forward portion 131 may extend a distance 134 of between and including 12 mm and 20 mm in a front-to-rear direction. While the above examples may describe particular distances, the apparatus, methods, and articles of manufacture described herein may include a forward portion extending a distance less than 12 mm in a front-to-rear direction. The apparatus, methods, and articles of manufacture described herein are not limited in this regard.

The forward portion 131 may enhance structural integrity of the golf club head 100 and resist rearward deflection of the front portion 170 during impact with a golf ball. The forward portion 131 may transfer an impact force to the crown portion 135 during an impact with a golf ball. The forward portion 131 may distribute an impact force along a surface of the crown portion that abuts a junction 132 formed between the crown portion 135 and the forward portion 131 of the top portion 130. The forward portion 131 may be an integral portion of the body portion 110. In examples where the body portion 110 is formed through a metal (e.g. titanium) casting process, the forward portion 131 may be formed as an integral portion of the body portion during the casting process. The apparatus, methods, and articles of manufacture described herein are not limited in this regard.

The crown portion 135 may be a separate piece that may be attached to the top portion 130. The crown portion 135 may enclose an opening 1201 in the top portion 130. The crown portion 135 may include a heel-side perimeter 1131, a front perimeter 1132, a rear perimeter 1151, and a toe-side perimeter 1133. The apparatus, methods, and articles of manufacture described herein are not limited in this regard.

Figure 12:
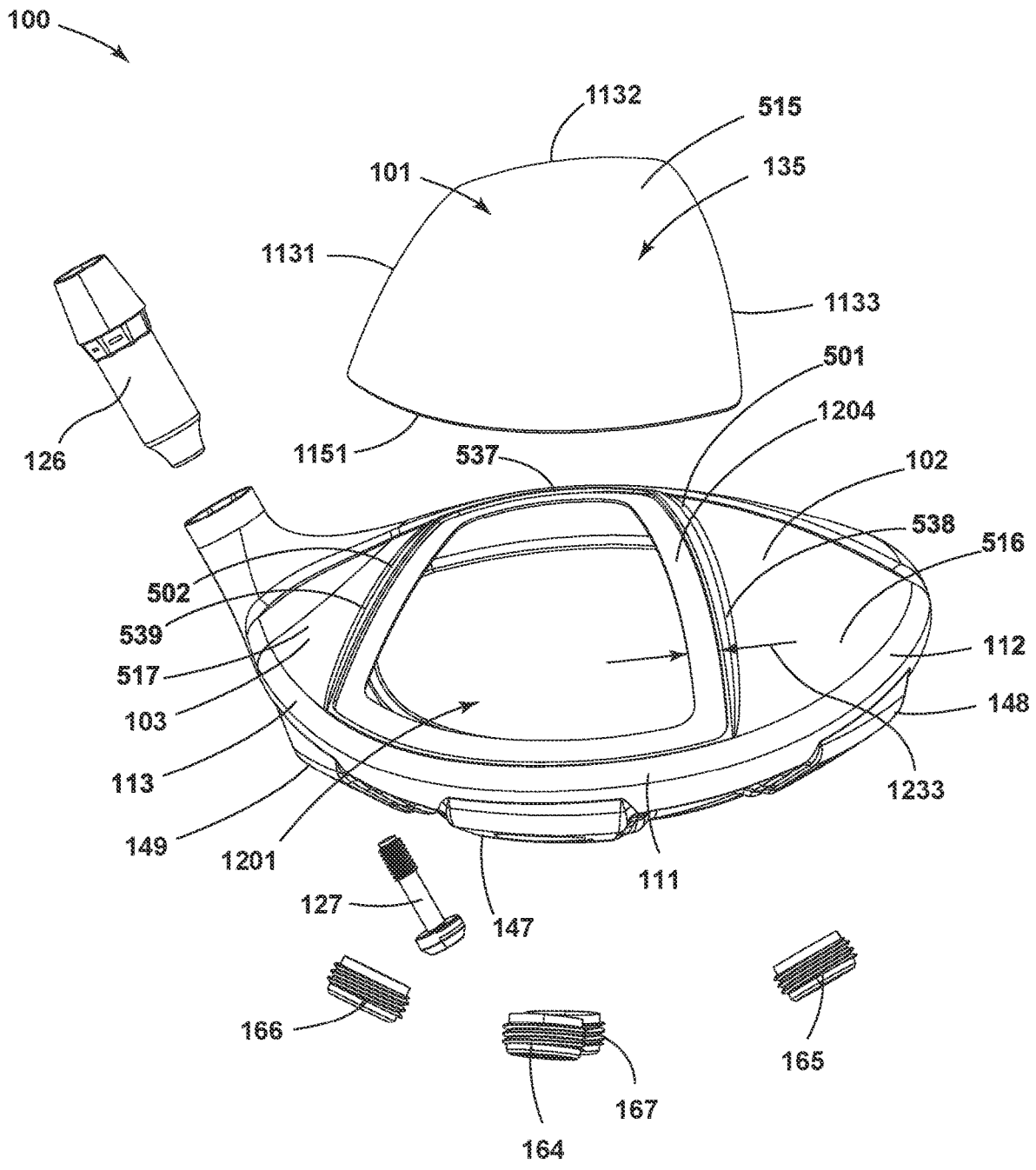
FIG. 12 is an exploded rear view of the golf club head of FIG. 1.
Figure 13:
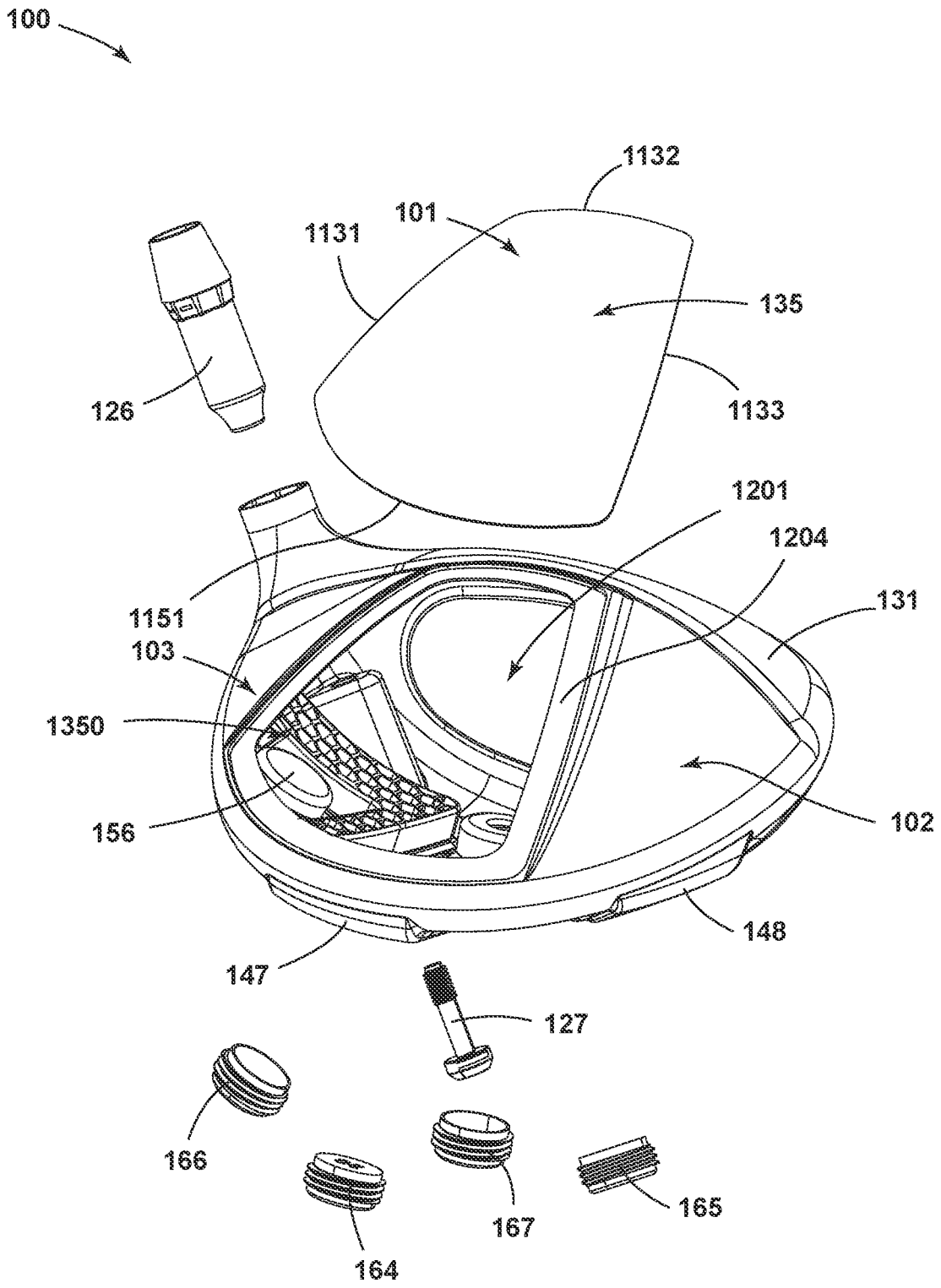
FIG. 13 is an exploded rear perspective view of the golf club head of FIG. 1.
Figure 14:
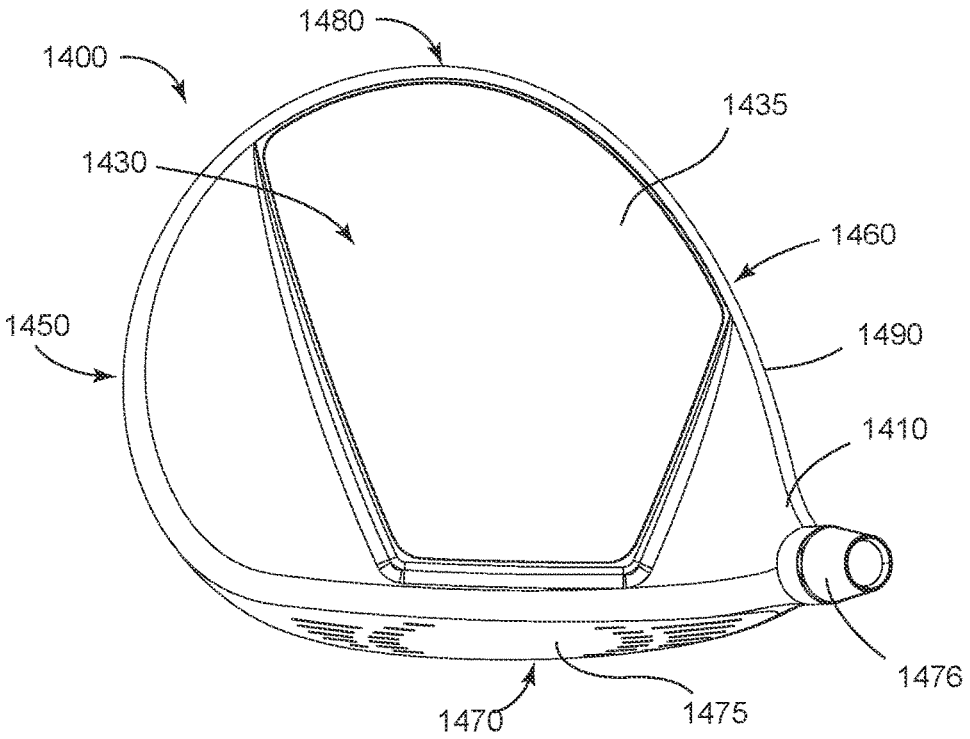
FIG. 14 is a top view of an example golf club head according to an embodiment of the apparatus, methods, and articles of manufacture described herein.
Figure 15:
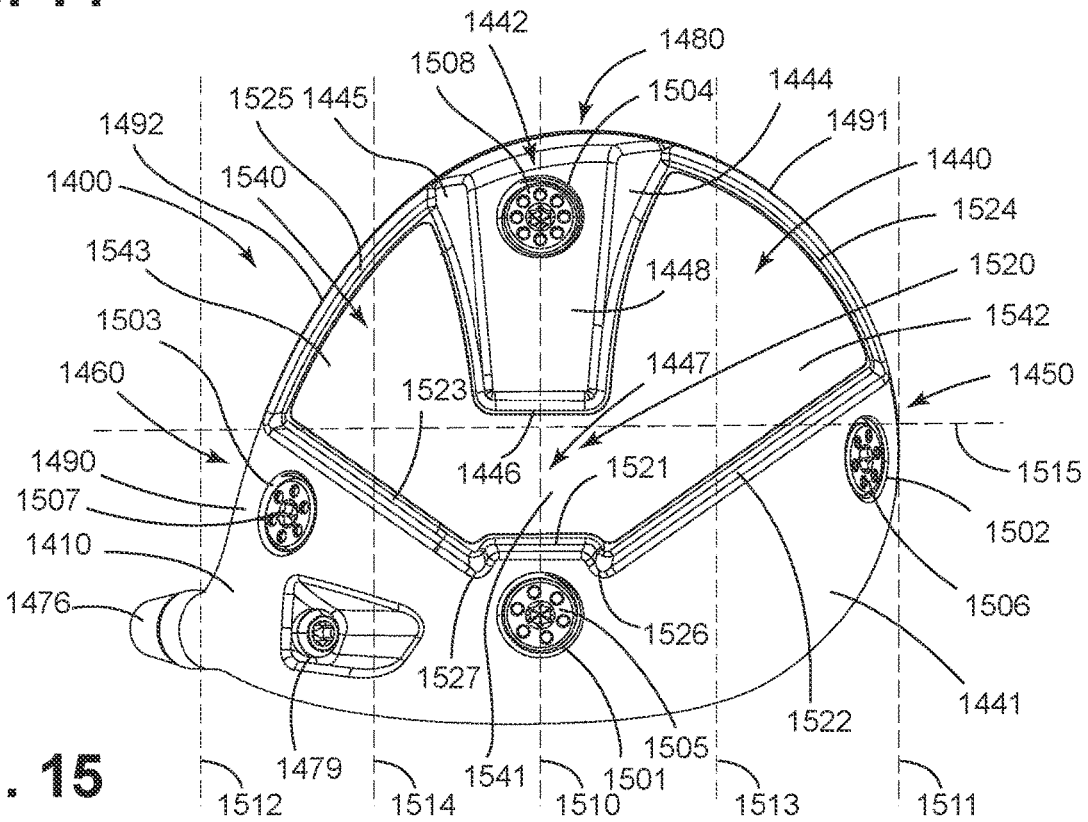
FIG. 15 is a bottom view of the golf club head of FIG. 14.
Figure 16:
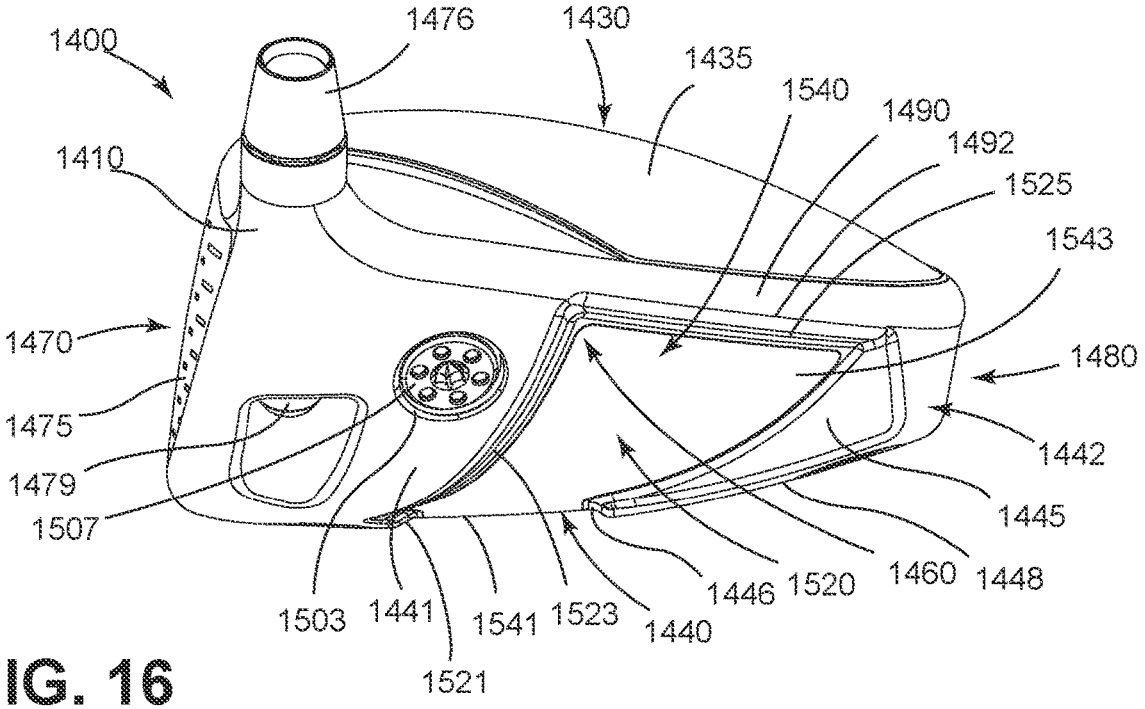
FIG. 16 is a heel side view of the golf club head of FIG. 14.
Figure 17:
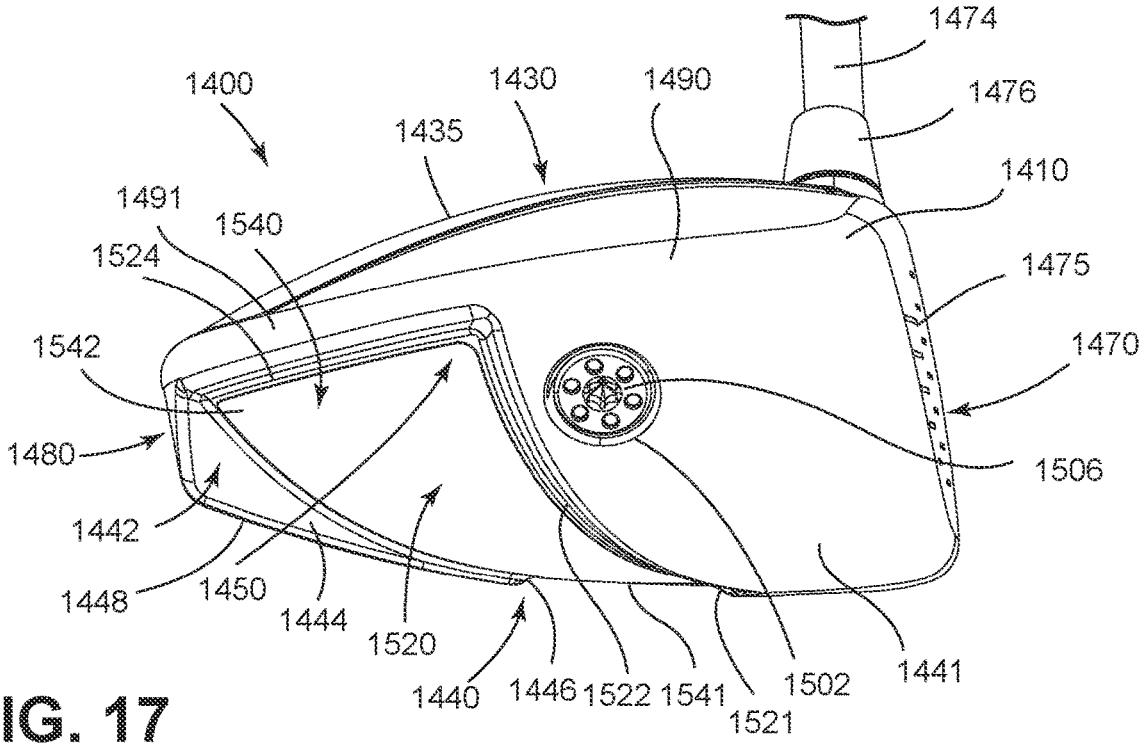
FIG. 17 is a toe side view of the golf club head of FIG. 14.
Figure 18:
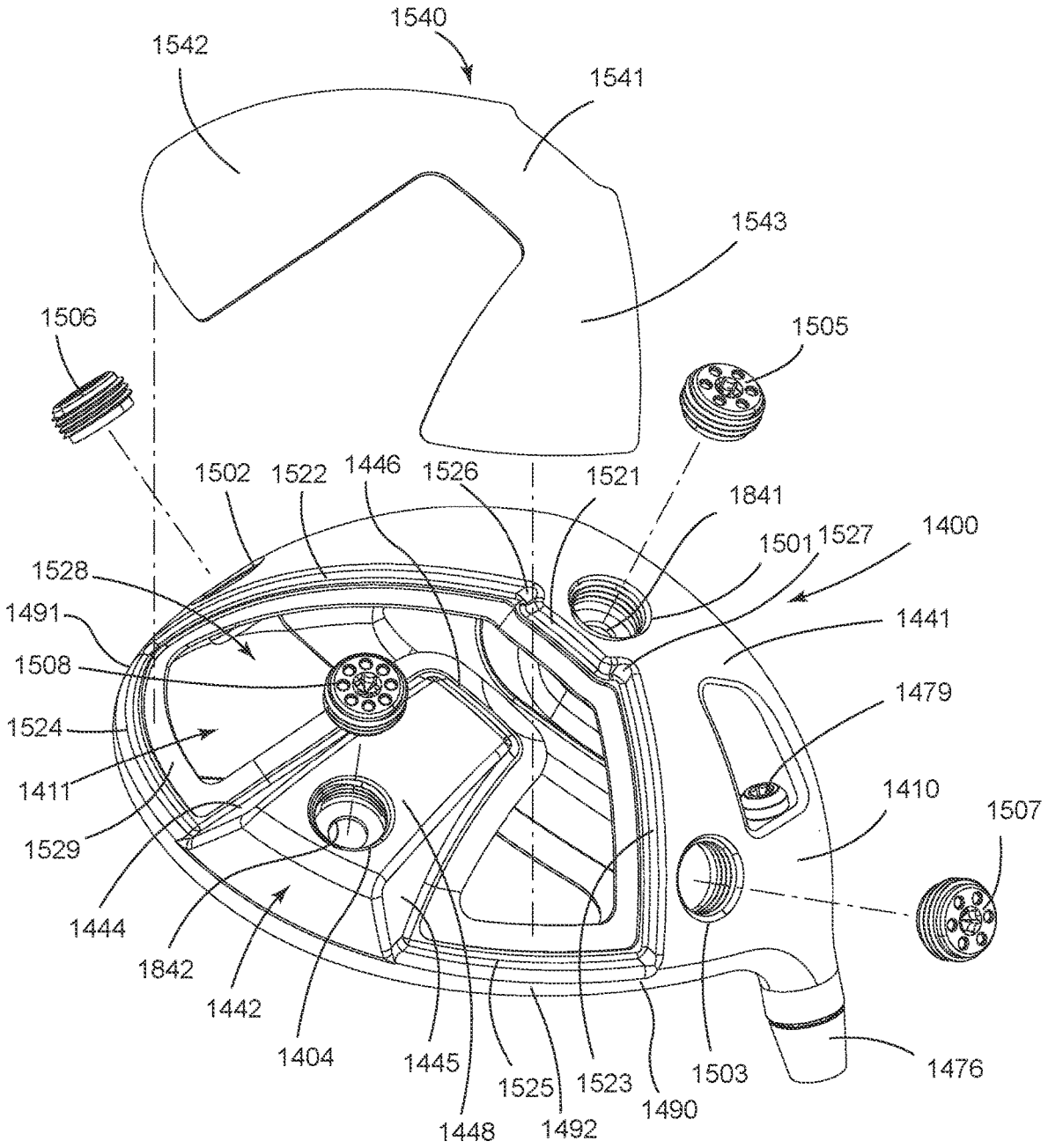
FIG. 18 is an exploded bottom heel side perspective view of the golf club head of FIG. 14.
Figure 19:
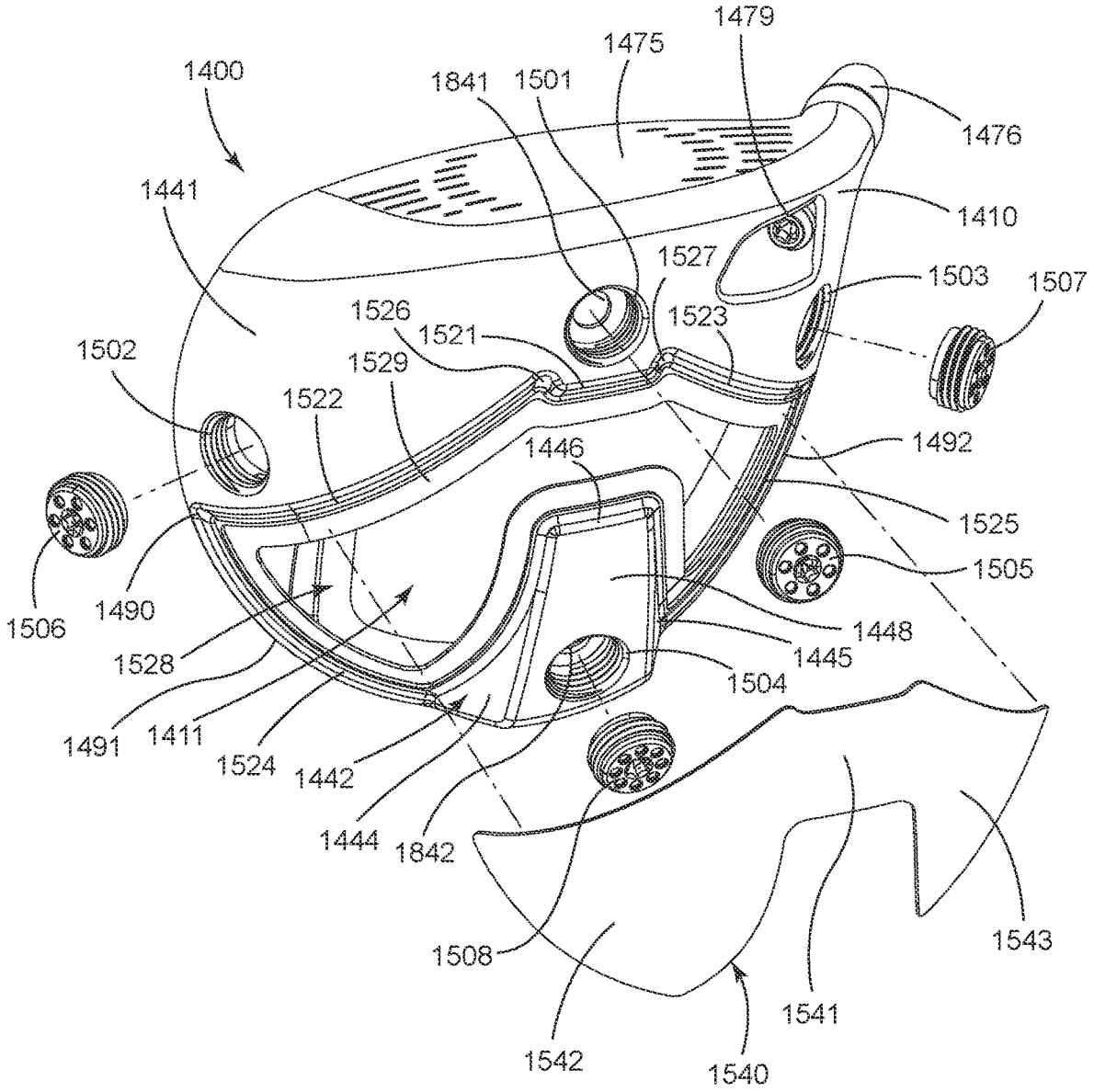
FIG. 19 is an exploded bottom toe side perspective view of the golf club head of FIG. 14.

As illustrated in FIGS. 12 and 13, for example, the top portion 130 of the golf club head 100 may include an opening 1201 prior to installation of the crown portion 135. The crown portion 135 may be constructed from one or more materials, and those materials may be the same or different from the material of the body portion 110. In one example, the crown portion 135 may be at least partially constructed from a composite material such as a fiber-based composite material. The crown portion 135 may be attached to a shoulder portion 1204 of the top portion 130. The shoulder portion 1204 may extend along an entire perimeter of the opening 1201 in the top portion 130 or a portion of the opening in the top portion 130. The shoulder portion 1204 may support the crown portion 135. The shoulder portion 1204 may provide a surface suitable for joining (e.g. adhering) the crown portion 135 to the top portion. In one example, the shoulder portion 1204 may extend a distance 1233 of at least 2 mm inward toward the opening 1201 in the top portion 130. In another example, the shoulder portion 1204 may extend a distance 1233 of at least 6 mm. In yet another example, the shoulder portion 1204 may extend a distance 1233 of at least 8 mm. In still another example, the shoulder portion 1204 may extend a distance 1233 of between and including 2 mm and 8 mm. While the above examples may describe particular distances, the apparatus, methods, and articles of manufacture described herein may include a shoulder portion 1204 that extends a distance 1233 less than 2 mm inward toward the opening in the top portion 130. The shoulder portion 1204 may be a continuous portion encircling the opening 1201 in the top portion 130. Alternately, the shoulder portion 1204 may include one or more discrete shoulder portions arranged to support the crown portion 135. In another example, the shoulder portion 1204 may include a plurality of tabs arranged to support the crown portion 135. In still another example, the shoulder portion 1204 may be omitted, and the crown portion 135 may be adhered to an outer surface of the top portion 130 or to an inner surface of the top portion 130. In yet another example, the shoulder portion 1204 may be omitted, and the crown portion 135 may include a protrusion extending from a bottom surface of the crown portion 135 that provides an interference fit with a perimeter edge of the opening 1201 in the top portion 130. The apparatus, methods, and articles of manufacture described herein are not limited in this regard.

In one example, the crown portion 135 may have a thickness of less than 1.0 mm. In another example, the crown portion 135 may have a thickness of less than 0.75 mm. In yet another example, the crown portion 135 may have a thickness of less than or equal to 0.65 mm. The crown portion 135 may be made of a composite material. While the above examples may describe particular thicknesses, the apparatus, methods, and articles of manufacture described herein may have a thickness greater than or equal to 1.0 mm. The apparatus, methods, and articles of manufacture described herein are not limited in this regard.

In one example, the crown portion 135 may form at least 45% of an exterior surface area of the top portion 130. In another example, the crown portion 135 may form at least 55% of an exterior surface area of the top portion 130. In yet another example, the crown portion 135 may form at least 65% of an exterior surface area of the top portion 130. While the above examples may describe particular percentages, the crown portion 135 may form less than 45% of the exterior surface area of the top portion 130. The apparatus, methods, and articles of manufacture described herein are not limited in this regard.

A top stiffening portion 136 may enhance stiffness of the top portion 130. The top stiffening portion 136 may compensate for the presence of one or more relatively less stiff, thin, or lightweight regions elsewhere in the top portion 130 or crown portion 135. The top stiffening portion 136 may enhance overall stiffness of the golf club head 100. The top stiffening portion 136 may limit rearward deflection of the face portion 275 and/or forward portion 131 toward the rear portion 180 in response to the face portion 275 impacting a golf ball. The top stiffening portion 136 may resist physical compression of the crown portion 135 in a front-to-rear direction in response to the face portion 275 impacting a golf ball, which may reduce risk of cracking or delaminating of the crown portion 135 in examples where the crown portion 135 is constructed of two or more layers of composite material. The top stiffening portion 136 may be a raised portion of the top portion 130. The top stiffening portion 136 may be part of a contoured portion of the top portion 130. The top stiffening portion 136 may serve as a visual alignment aid for a golfer aligning a golf shot. The top stiffening portion 136 may improve acoustic response of the golf club head 100 in response to the face portion 275 impacting a golf ball. The top stiffening portion 136 may have a thickness greater than another region of the top portion 130 or the crown portion 135. The top stiffening portion 136 may have a thickness greater than an average thickness of the crown portion 135. The top stiffening portion 136 may be integral to the top portion 130. The top stiffening portion 136 may be one or more separate portions adhered or joined to the top portion 130 to provide structural reinforcement. The apparatus, methods, and articles of manufacture described herein are not limited in this regard.

As mentioned above, the top portion 130 may include one or more top stiffening portions. In one example, the top stiffening portion 136 may include a first top stiffening portion 137, a second top stiffening portion 138, and a third top stiffening portion 139, as shown in FIG. 1. The first top stiffening portion 137 may be located adjacent to the forward portion 131 of the top portion 130. The first top stiffening portion 137 may have a thickness greater than an average thickness of the crown portion 135. In one example, the first top stiffening portion 137 may have a thickness of greater than 2 mm. In another example, the first top stiffening portion 137 may have a thickness of greater than or equal to 2.1 mm. In another example, the first top stiffening portion 137 may have a thickness of greater than or equal to 2.2 mm. In still another example, the first top stiffening portion 137 may have a thickness of greater than or equal to 2.4 mm. While the above examples may describe particular thickness, the apparatus, methods, and articles of manufacture described herein may include the first top stiffening portion 137 with a thickness of less than or equal to 2 mm. In one example, the first top stiffening portion 137 may have a length of at least 1.25 cm in a heel-to-toe direction. In another example, the first top stiffening portion 137 may have a length of at least 2 cm in a heel-to-toe direction. In yet another example, the first top stiffening portion 137 may have a length of at least 3 cm in a heel-to-toe direction. In still yet another example, the first top stiffening portion 137 may have a length of at least 4 cm in a heel-to-toe direction. In another example, the first top stiffening portion 137 may have a length of between and including 4 and 4.5 cm in a heel-to-toe direction. While the above examples may describe particular lengths, the apparatus, methods, and articles of manufacture describe herein may include the first top stiffening portion 137 having a length of less than 3 cm. The first top stiffening portion 137 may reduce aerodynamic drag of the golf club head 100. The apparatus, methods, and articles of manufacture described herein are not limited in this regard.

The second top stiffening portion 138 may extend from the first top stiffening portion 137 toward the rear portion 180. The second top stiffening portion 138 may extend from the first top stiffening portion 137 toward the rear portion 180 and toward the toe portion 150. The second top stiffening portion 138 may extend from a toe-side end of the first top stiffening portion 137 to a rear perimeter of the crown portion 135. The second top stiffening portion 138 may extend from the first top stiffening portion 137 toward a weight port region on the bottom portion 140. The second top stiffening portion 138 may extend from the first top stiffening portion 137 toward a weight port region on the bottom portion 140, where the weight port region is closer to the toe portion 150 than other weight port regions on the bottom portion. The second top stiffening portion 138 may taper in width in a front-to-rear direction. The apparatus, methods, and articles of manufacture described herein are not limited in this regard.

The second top stiffening portion 138 may serve as a support structure between the forward portion 131 and the rear portion 180. The second top stiffening portion 138 may oppose rearward deflection of the forward portion 131 in response to the face portion 275 impacting a golf ball. The second top stiffening portion 138 may have a thickness greater than an average thickness of the crown portion 135. The second top stiffening portion 138 may have a thickness of greater than 2 mm. The second top stiffening portion 138 may have a thickness of greater than or equal to 2.1 mm. The second top stiffening portion 138 may have a thickness of greater than or equal to 2.2 mm. While the above examples may describe particular thicknesses, the apparatus, methods, and articles of manufacture described herein may include the second top stiffening portion 138 with a thickness of less than or equal to 2 mm. In one example, the second top stiffening portion 138 may have a length of at least 2 cm. In another example, the second top stiffening portion 138 may have a length of at least 4 cm. While the above examples may describe particular lengths, the apparatus, methods, and articles of manufacture describe herein may include a second top stiffening portion 138 having a length less than 2 cm. The second top stiffening portion 138 may reduce aerodynamic drag of the golf club head. The apparatus, methods, and articles of manufacture described herein are not limited in this regard.

The third top stiffening portion 139 may extend from the first top stiffening portion 137 toward the rear portion 180. The third top stiffening portion 139 may extend from the first top stiffening portion 137 toward the rear portion 180 and toward the heel portion 160. The third top stiffening portion 139 may extend from a heel-side end of the first top stiffening portion 137 to a rear perimeter of the crown portion 135. The third top stiffening portion 139 may extend from the first top stiffening portion 137 toward a weight port region on the bottom portion 140. The third top stiffening portion 139 may extend from the first top stiffening portion 137 toward a weight port region on the bottom portion 140, where the weight port region is closer to the heel portion 160 than other weight port regions on the bottom portion. The third top stiffening portion 139 may taper in width in a front-to-rear direction. The apparatus, methods, and articles of manufacture described herein are not limited in this regard.

The third top stiffening portion 139 may serve as a support structure between the forward portion 131 and the rear portion 180. The third top stiffening portion 139 may oppose rearward deflection of the forward portion 131 in response to the face portion 275 impacting a golf ball. The third top stiffening portion 139 may have a thickness greater than an average thickness of the crown portion 135. The third top stiffening portion 139 may have a thickness of greater than 2 mm. The third top stiffening portion 139 may have a thickness of greater than or equal to 2.1 mm. The third top stiffening portion 139 may have a thickness of greater than or equal to 2.2 mm. While the above examples may describe particular thicknesses, the apparatus, methods, and articles of manufacture described herein may include the third top stiffening portion 139 with a thickness of less than or equal to 2 mm. The third top stiffening portion 139 may have a length of at least 2 cm. The third top stiffening portion 139 may have a length of at least 4 cm. The third top stiffening portion 139 may reduce aerodynamic drag of the golf club head. While the above example may describe a particular number of top stiffening portions, the apparatus, methods, and articles of manufacture described herein may include more or fewer top stiffening portions. The apparatus, methods, and articles of manufacture described herein are not limited in this regard.

Figure 7:
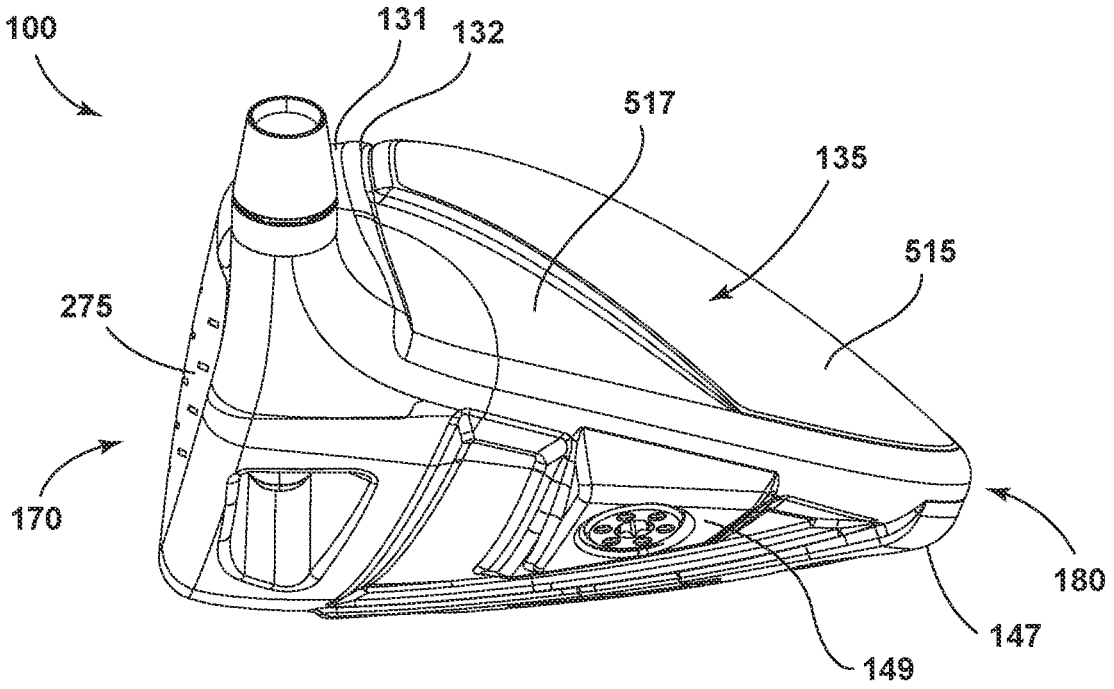
FIG. 7 is a heel side view of the golf club head of FIG. 1.

The top portion 130 may include a central top portion 101, a toe-side top portion 102, and a heel-side top portion 103. The central top portion 101 may be a raised central top portion 101. The raised central top portion 101 may be located between the heel-side top portion 103 and the toe-side top portion 102. The raised central top portion 101 may have a maximum height greater than a maximum height of the toe-side top portion 102, as shown in FIG. 8. The raised central top portion 101 may have a maximum height greater than a maximum height of the heel-side top portion 103, as shown in FIG. 7. The raised central top portion 101 may serve as a visual alignment aid. The raised central top portion 101 may improve aerodynamic performance of the golf club head 100. The raised central top portion 101 may stiffen the top portion 130 and reduce deflection (e.g. bulging) of the top portion 130 in response to the face portion 275 impacting a golf ball. Reducing bulging of the top portion 130 may be desirable to reduce shear stress on a joint (e.g. an adhesive bond) between the crown portion 135 and the shoulder portion 1204 of the opening 1201 in the top portion 130. The apparatus, methods, and articles of manufacture described herein are not limited in this regard.

The central top portion 101 may include a thin portion. The toe-side top portion 102 may include a thin portion. The heel-side top portion 103 may include a thin portion. Thin portions may be desirable to reduce overall mass of the top portion 130, which may lower the CG of the golf club head 100. The apparatus, methods, and articles of manufacture described herein are not limited in this regard.

The top portion 130 may include a plurality of contoured surfaces. The plurality of contoured surfaces may generate turbulent flow across the top portion 130 of the golf club head 100 during a golf swing. The plurality of contoured surfaces may reduce aerodynamic drag of the golf club head 100. The plurality of contoured surfaces may enhance rigidity of the golf club head 100. The plurality of contoured surfaces may enhance structural integrity of the golf club head 100. The apparatus, methods, and articles of manufacture described herein are not limited in this regard An outer surface 515 of the central top portion 101 may be elevated above an outer surface 516 of the toe-side top portion 102. The outer surface 515 area of the central top portion 101 may be elevated above an outer surface 517 of the heel-side top portion 103. The apparatus, methods, and articles of manufacture described herein are not limited in this regard. The apparatus, methods, and articles of manufacture described herein are not limited in this regard The top portion 130 may include a first contoured transition region 501 located between the central top portion 101 and the toe-side top portion 102. The crown portion 135 may include a second contoured transition region 502 located between the central top portion 101 and the heel-side top portion 103. The location of the first contoured transition region 501 may coincide with the location of the second top stiffening portion 138. The location of the second contoured transition region 502 may coincide with the location of the third top stiffening portion 139. Together, the central top portion 101, toe-side top portion 102, heel-side top portion 103, first contoured transition region 501, and second contoured transition region 502 may form a multi-level top portion 130. Together, the central top portion 101, toe-side top portion 102, heel-side top portion 103, first contoured transition region 501, and second contoured transition region 502 may form a multi-thickness top portion 130. The apparatus, methods, and articles of manufacture described herein are not limited in this regard.

Figure 5:
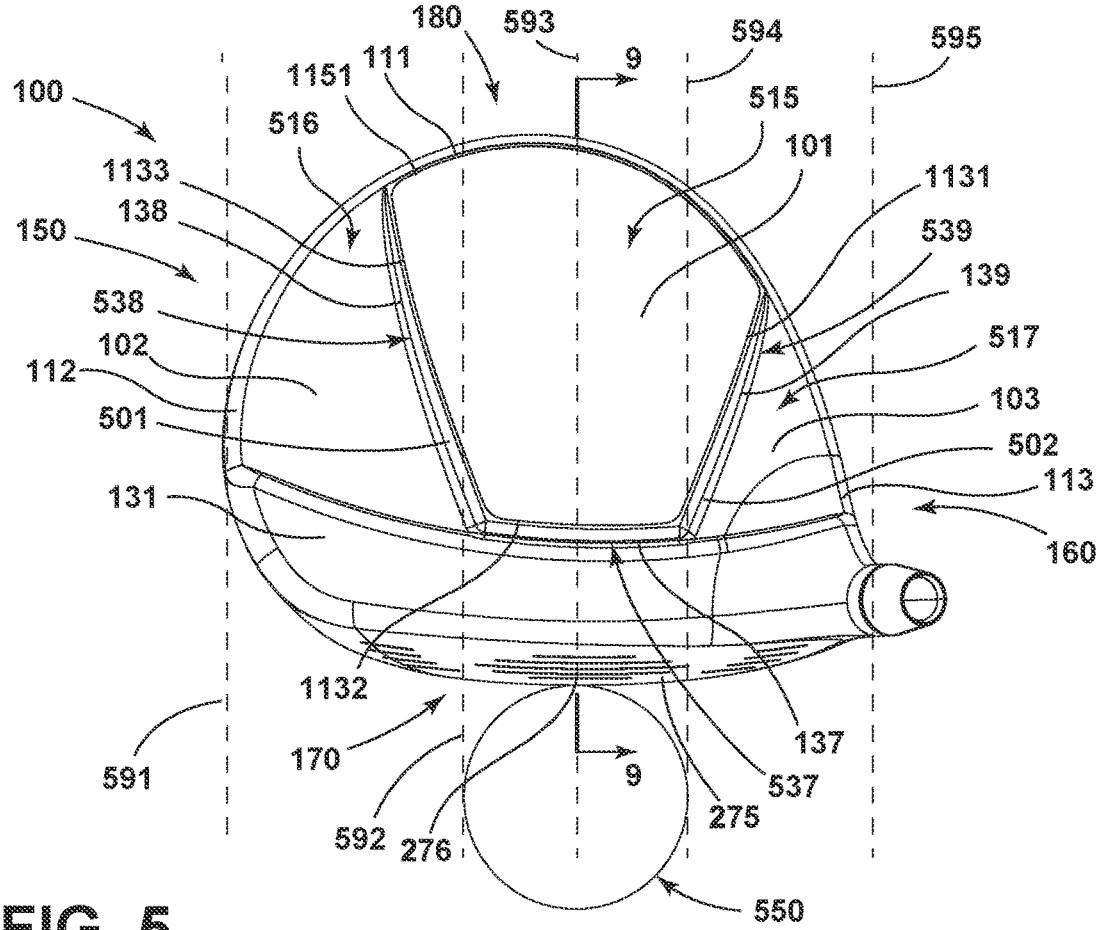
FIG. 5 is a top view of the golf club head of FIG. 1.
Figure 9:
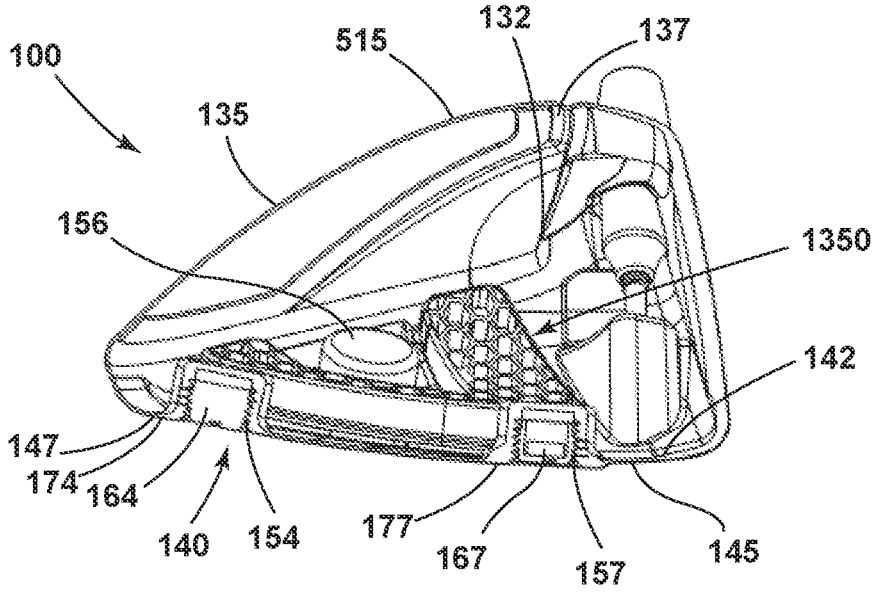
FIG. 9 is a cross-sectional view of the golf club head of FIG. 1 taken along section 9-9 of FIG. 5.

FIG. 9 depicts a cross-sectional toe side view of the example golf club head of FIG. 1 taken at section line 9-9 of FIG. 5. The outer surface 515 of the central top portion 101 may be elevated above an outer surface 517 of the heel-side top portion 103. In one example, the outer surface 515 of the central top portion 101 may be elevated above an outer surface 517 of the heel-side top portion 103 by a height of greater than or equal to 0.5 mm. In another example, the outer surface 515 of the central top portion 101 may be elevated above an outer surface 517 of the heel-side top portion 103 by a height of greater than or equal to 1.0 mm. In yet another example, the outer surface 515 of the central top portion 101 may be elevated above an outer surface 517 of the heel-side top portion 103 by a height of greater than or equal to 2.0 mm. The apparatus, methods, and articles of manufacture described herein are not limited in this regard.

The outer surface 515 of the central top portion 101 may be elevated above an outer surface 516 of the toe-side top portion 102. In one example, the outer surface 515 of the central top portion 101 may be elevated above an outer surface 516 of the toe-side top portion 102 by a height of greater than or equal to 0.5 mm. In another example, the outer surface 515 of the central top portion 101 may be elevated above an outer surface 516 of the toe-side top portion 102 by a height of greater than or equal to 1.0 mm. In yet another example, the outer surface 515 of the central top portion 101 may be elevated above an outer surface 516 of the toe-side top portion 102 by a height of greater than or equal to 2.0 mm. While the above examples may describe particular heights, the apparatus, methods, and articles of manufacture described herein may include outer surfaces with a difference in height of less than 0.5 mm. The apparatus, methods, and articles of manufacture described herein are not limited in this regard.

As shown in FIG. 7, the outer surface 517 of the heel-side top portion 103 may be recessed below the forward portion 131 proximate to the junction 132. Likewise, as shown in FIG. 8, the outer surface 516 of the toe-side top portion 102 may be recessed below the forward portion 131 proximate the junction 132. In one example, the outer surface 517 of the heel-side top portion 103 may be recessed below the forward portion 131 proximate to the junction 132 by a distance of greater than or equal to 0.5 mm. In another example, the outer surface 517 of the heel-side top portion 103 may be recessed below the forward portion 131 proximate to the junction 132 by a distance of greater than or equal to 1.0 mm. In yet another example, the outer surface 516 of the toe-side top portion 102 may be recessed below the forward portion 131 proximate the junction 132 by a distance of greater than or equal to 0.5 mm. The outer surface 516 of the toe-side top portion 102 may be recessed below the forward portion 131 proximate the junction 132 by a distance of greater than or equal to 1.0 mm. While the above examples may describe particular distances, the apparatus, methods, and articles of manufacture described herein may include outer surfaces recessed by distances of less than 0.5 mm. The apparatus, methods, and articles of manufacture described herein are not limited in this regard.

The central top portion 101 may be bounded by the first contoured transition region 501, the second contoured transition region 502, a rear perimeter 1151, and a front perimeter 1132, as shown in FIGS. 5 and 12. The central top portion 101 may be bounded by the first contoured transition region 501, the second contoured transition region 502, a rear body perimeter 111, and a front perimeter 1132, as shown in FIG. 5. The central top portion 101 may be bounded by the first top stiffening portion 137, the second top stiffening portion 138, the third top stiffening portion 139, and the rear perimeter 1151, as shown in FIG. 5. The apparatus, methods, and articles of manufacture described herein are not limited in this regard.

A front region of the central top portion 101 may have a symmetrical shape relative to a central vertical plane 593 that intersects the geometric center (e.g., at or proximate to a "sweet spot" of the golf club head 100) on the face portion 275 and is normal to a front vertical plane. A front portion of the central top portion 101 may have a nonsymmetrical shape relative to the central vertical plane 593 that intersects the geometric center on the face portion 275 and is normal to the front vertical plane. The apparatus, methods, and articles of manufacture described herein are not limited in this regard.

In one example, the second top stiffening portion 138 and third top stiffening portion 139 may diverge in a front-to-rear direction, as shown in FIG. 5. The central top portion 101 may have an irregular polygon-like shape (e.g., a quadrilateral-like shape). The distance between the second and third top stiffening portions 138 and 139 at or proximate to the front portion 170 may be less than the distance between the second and third top stiffening portions 138 and 139 at or proximate to the rear portion 180. In another example, the second top stiffening portion 138 and third top stiffening portion 139 may converge in a front-to-rear direction. A distance between the second and third top stiffening portions 138 and 139 at or proximate to the front portion 170 may be greater than a distance between the second and third top stiffening portions 138 and 139 at or proximate to the rear portion 180. In yet another example, the second top stiffening portion 138 and third top stiffening portion 139 may converge and then diverge in a front-to-rear direction. In another example, the second top stiffening portion 138 and third top stiffening portion 139 may diverge and then converge in a front-to-rear direction. In still another example, the second top stiffening portion 138 and third top stiffening portion 139 may be substantially parallel in a front-to-rear direction. The distance between the second stiffening portion 138 and third top stiffening portion 139 at or proximate to the front portion 170 may be equal or substantially the same as the distance between the second and third top stiffening portions 138 and 139 at or proximate to the rear portion 180. The apparatus, methods, and articles of manufacture described herein are not limited in this regard.

In one example, as shown in FIG. 1, the central top portion 101 may be raised relative to the toe-side top portion 102 and the heel-side top portion 103, resulting in a raised central top portion 101. Variations in relative heights of the central top portion 101, toe-side top portion 102, and heel-side top portion 103 may improve aerodynamic performance by reducing a drag coefficient associated with the golf club head 100. Variations in relative heights of the central top portion 101, toe-side top portion 102, and heel-side top portion 103 may provide a visual alignment aid. Variations in relative heights of the central top portion 101, toe-side top portion 102, and heel-side top portion 103, together with contoured transition regions (501, 502) with integral ribs, may enhance structural integrity of the top portion 130. In another example, the central top portion 101 may be depressed relative to the toe-side top portion 102 and the heel-side top portion 103. The apparatus, methods, and articles of manufacture described herein are not limited in this regard.

The total surface area of the top portion 130 may include surface areas of the central top portion 101, toe-side top portion 102, heel-side top portion 103, first contoured transition region 501, second contoured transition region 502, and the forward portion 131. In one example, the surface area of the central top portion 101 may be less than or equal to 40% of the total surface area of the top portion 130. In another example, the surface area of the central top portion 101 may be at least 10% of the total surface area of the top portion 130. In another example, the surface area of the central top portion 101 may be at least 20% of the total surface area of the top portion 130. In yet another example, the surface area of the central top portion 101 may be at least 30% of the total surface area of the top portion 130. In still yet another example, the surface area of the central top portion 101 may be at least 40% of the total surface area of the top portion 130. In still yet another example, the surface area of the central top portion 101 may be at least 50% of the surface area of the top portion 130. In another example, the surface area of the central top portion 101 may be at least 60% of the total surface area of the top portion 130. In still yet another example, the surface area of the central top portion 101 may be at least 70% of the total surface area of the top portion 130. In still yet another example, the surface area of the central top portion 101 may be at least 80% of the total surface area of the top portion 130. In still yet another example, the surface area of the central top portion 101 may be at least 90% of the total surface area of the top portion 130. The apparatus, methods, and articles of manufacture described herein are not limited in this regard.

The toe-side top portion 102 may be bounded by the first contoured transition region 501, a toe-side body perimeter 112, and the forward portion 131. In one example, the surface area of the toe-side top portion 102 may be at least 5% of the total surface area of the top portion 130. In another example, the surface area of the toe-side top portion 102 may be at least 10% of the total surface area of the crown portion 135. In yet another example, the surface area of the toe-side top portion 102 may be at least 15% of the total surface area of the top portion 130. In still yet another example, the surface area of the toe-side top portion 102 may be at least 20% of the surface area of the top portion 130. In still yet another example, the surface area of the toe-side top portion 102 may be at least 25% of the total surface area of the top portion 130. In still yet another example, the surface area of the toe-side top portion 102 may be at least 30% of the total surface area of the top portion 130. In still yet another example, the surface area of the toe-side top portion 102 may be at least 35% of the total surface area of the top portion 130. In still yet another example, the surface area of the toe-side top portion 102 may be at least 40% of the total surface area of the top portion 130. The apparatus, methods, and articles of manufacture described herein are not limited in this regard.

The heel-side top portion 103 may be bounded by the second contoured transition region 502, a heel-side body perimeter 113, and the forward portion 131. In one example, the surface area of the heel-side top portion 103 may be at least 5% of the total surface area of the top portion 130. In another example, the surface area of the heel-side top portion 103 may be at least 10% of the total surface area of the top portion 130. In yet another example, the surface area of the heel-side top portion 103 may be at least 15% of the total surface area of the top portion 130. In still yet another example, the surface area of the heel-side top portion 103 may be at least 20% of the total surface area of the top portion 130. In still yet another example, the surface area of the heel-side top portion 103 may be at least 25% of the total surface area of the top portion 130. In still yet another example, the surface area of the heel-side top portion 103 may be at least 30% of the total surface area of the top portion 130. The apparatus, methods, and articles of manufacture described herein are not limited in this regard.

In one example, the outer surface 515 area of the central top portion 101 may be greater than or equal to 40% of a total outer surface area of the top portion 130, the outer surface 516 area of the toe-side top portion 102 may be less than or equal to 30% of the total outer surface area of the top portion 130, and the outer surface 517 area of the heel-side top portion 103 be less than or equal to 15% of the total outer surface area of the top portion 130. In another example, the outer surface area 515 of the central top portion 101 may be greater than or equal to 50% of a total outer surface area of the top portion 130, the outer surface area of the toe-side top portion 102 may be greater than or equal to 15% of the total outer surface area of the top portion 130, and the outer surface area of the heel-side top portion 103 be greater than or equal to 5% of the total outer surface area of the top portion 130. In another example, the outer surface area 515 of the central top portion 101 may be greater than or equal to 30% of a total outer surface area of the top portion 130, the outer surface area of the toe-side top portion 102 may be greater than or equal to 10% of the total outer surface area of the top portion 130, and the outer surface area of the heel-side top portion 103 be greater than or equal to 5% of the total outer surface area of the top portion 130. The apparatus, methods, and articles of manufacture described herein are not limited in this regard.

FIG. 5 depicts a top view of the example golf club head 100 of FIG. 1 with a golf ball 550 proximate to the face portion 275. The golf ball 550 may be in contact with and aligned with a geometric center 276 of the face portion 275. The golf ball 550 may have a diameter of about 1.68 inches. A central vertical plane 593 bisects the golf ball 550 and the golf club head 100. A toe-side bounding plane 591 bounds a toe-side of the golf club head 100. A heel-side bounding plane 595 bounds a heel-side of the golf club head 100. A toe-side dividing plane 592 divides the toe-side of the golf club head and bounds a toe-side of the golf ball 550. A heel-side dividing plane 594 divides the heel-side of the golf club head and bounds a heel-side of the golf ball 550. The top portion 130 may include a perimeter that includes a toe-side perimeter, heel-side perimeter, front perimeter, and rear perimeter. The apparatus, methods, and articles of manufacture described herein are not limited in this regard.

The top portion 130 of the golf club head 100 may include a plurality of integral ribs. The integral ribs may form the top stiffening portion 136. The integral ribs (e.g., generally shown as 537, 538, and 539) may provide embedded structural supports within the top portion 130. Each integral rib may be located in a top stiffening region adjacent to one or more thin portions. The top portion 130 may have contoured transition regions (e.g., generally shown as 501 and 502) between the thin portions and the thicker top stiffening portions where the integral ribs reside. Contoured transition regions may prevent or mitigate unwanted stress concentrations within the top portion 130 by avoiding distinct edges between thin portions and adjacent thicker portions (e.g., such as 137, 138, or 139). Stress concentrations may be undesirable as they may result in cracking or delaminating of layers of the top portion 130 during use of the golf club head 100. For example, in an alternative embodiment having non-integral ribs attached to either an inner or outer surface of the top portion 130, a distinct edge may exist at a junction formed between a non-integral rib and a surface of the top portion 130, and that edge may introduce an unwanted stress concentration. After numerous ball strikes, presence of the stress concentration may result in cracking of the top portion 130 proximate to the non-integral rib. This physical deterioration of the top portion 130 may negatively impact performance of the golf club head 100. For instance, as the top portion 130 physically deteriorates, shot-to-shot variability may increase. Shot-to-shot variability may be unacceptable to an individual who requires consistent performance from the golf club head 100. Physical deterioration of the top portion 130 may also negatively affect appearance of the golf club head 100. For the sake of long-term durability, consistency, and appearance, it is therefore desirable to have a top portion 130 with contoured transition regions (501, 502) between the thin portions and the thicker portions containing integral ribs. The apparatus, methods, and articles of manufacture described herein are not limited in this regard.

The top portion 130 may include a toe-side integral rib 538. The toe-side integral rib 538 may extend from the front perimeter 1132 of the crown portion 135 to the rear perimeter 1151 of the crown portion. The toe-side integral rib 538 may extend rearward from the forward portion 131. The toe-side integral rib 538 may extend rearward from a starting location between the central vertical plane 593 and the toe-side dividing plane 592 and terminate at an ending location between the toe-side bounding plane 591 and the toe-side dividing plane 592. The apparatus, methods, and articles of manufacture described herein are not limited in this regard.

In one example, the toe-side integral rib 538 may have a maximum thickness between and including 1.0 mm and 2.0 mm. In another example, the toe-side integral rib 538 may have a maximum thickness greater than or equal to 1.0 mm. In another example, the toe-side integral rib 538 may have a maximum thickness greater than or equal to 2.0 mm. In another example, the toe-side integral rib 538 may have a maximum thickness greater than or equal to 2.1 mm. In yet another example, the toe-side integral rib 538 may have a maximum thickness greater than or equal to 2.2 mm. In yet another example, the toe-side integral rib 538 may have a maximum thickness greater than or equal to 2.4 mm. While the above examples may describe particular thicknesses, the apparatus, methods, and article of manufacture described herein may include the toe-side integral rib 538 with a maximum thickness of less than 2 mm. The apparatus, methods, and articles of manufacture described herein are not limited in this regard.

The top portion 130 may include a heel-side integral rib 539. The heel-side integral rib 539 may extend from a front perimeter 1132 of the crown portion 135 to a rear perimeter 1151 of the crown portion. The heel-side integral rib 539 may extend rearward from the forward portion 131. The heel-side integral rib 539 may extend rearward from a starting location between the central vertical plane 593 and the heel-side dividing plane 594 and terminate at an ending location between the heel-side bounding plane 595 and the heel-side dividing plane 594. The apparatus, methods, and articles of manufacture described herein are not limited in this regard.

In one example, the heel-side integral rib 539 may have a maximum thickness between and including 1.0 mm and 2.0 mm. In another example, the heel-side integral rib 539 may have a maximum thickness greater than or equal to 1.0 mm. In another example, the heel-side integral rib 539 may have a maximum thickness greater than or equal to 2.0 mm. In another example, the heel-side integral rib 539 may have a maximum thickness greater than or equal to 2.1 mm. In yet another example, the heel-side integral rib 539 may have a maximum thickness greater than or equal to 2.4 mm. While the above examples may describe particular thicknesses, the apparatus, methods, and article of manufacture described herein may include the heel-side integral rib 539 with a maximum thickness of less than 2 mm. The apparatus, methods, and articles of manufacture described herein are not limited in this regard.

The top portion 130 may include a central integral rib 537. The central integral rib 537 may extend along the front perimeter 1132 of the crown portion 135. The central integral rib 537 may extend from the toe-side integral rib 538 to the heel-side integral rib 539. The central integral rib 537 may extend from a forward-most end of the toe-side integral rib 538 to a forward-most end of the heel-side integral rib 539. The central integral rib 537 may extend a distance of at least 3 centimeters beside the junction 132 formed between the front perimeter 1132 of the crown portion 135 and the forward portion 131 of the top portion 130. The central integral rib 537 may be located between the toe-side dividing plane 592 and the heel-side dividing plane 594. The central integral rib 537 and the face portion 275 may have parallel curves. In one example, the central integral rib 537 may have a maximum thickness greater than or equal to 2.0 mm. In another example, the central integral rib 537 may have a maximum thickness greater than or equal to 2.1 mm. In yet another example, the central integral rib 537 may have a maximum thickness greater than or equal to 2.4 mm. While the above examples may describe particular thicknesses, the apparatus, methods, and article of manufacture described herein may include the central integral rib 537 with a maximum thickness of less than 2 mm. The apparatus, methods, and articles of manufacture described herein are not limited in this regard.

The integral ribs (e.g., generally shown as 537, 538, and 539) may enhance the flexural strength of the top portion 130. The integral ribs may enhance the compressive strength of the top portion 130. The integral ribs may reduce outward deflection (e.g., bulging) of the top portion 130 in response to an impact force transferred from the body portion 110 to the crown portion 135 during impact with a golf ball. The integral ribs may reduce deflection of the crown portion 135 inward toward in the interior cavity of the golf club head 100 in response to a downward force applied to an outer surface of the crown portion 135. Inward deflection of the crown portion 135 may be easier to accurately measure in a test environment than outward deflection. In certain instances, resistance to inward deflection may correlate to resistance to outward deflection. Inward deflection may be measured by applying a downward force to an outer surface of the crown portion and measuring physical deflection of the crown portion with a suitable measuring device. In one example, when a downward force of 200 pound-force (lbf) is applied to the central top portion 101, the central top portion 101 may deflect less than 0.025 inch. In another example, when a downward force of 200 lbf is applied to the central top portion 101, the central top portion 101 may deflect less than 0.015 inch. In another example, when a downward force of 200 lbf is applied to the central top portion 101, the central top portion 101 may deflect less than 0.012 inch. The apparatus, methods, and articles of manufacture described herein are not limited in this regard.

Certain rules or regulations imposed by the USGA or other governing bodies may limit a spring-like effect of certain designs, materials, or constructions of golf club heads. To ensure a club head 100 conforms to certain rules and regulations, it may therefore be desirable to minimize spring-like effects of certain aspects of the club head. For instance, it may be desirable to minimize a spring-like effect of the top portion 130 by reinforcing the crown portion to minimize deflection during use. The integral ribs may allow the top portion 130 to resist deflection better than a similar lightweight crown portion that lacks integral ribs. In one example, the top portion 130 with integral ribs may only deflect inward about 0.012 inch whereas a crown portion without integral ribs may deflect about 0.020 inch in response to applying a downward force of 200 lbf to the respective crown portions. The apparatus, methods, and articles of manufacture described herein are not limited in this regard.

As shown in FIG. 5, the toe-side integral rib 538 and the heel-side integral rib 539 may diverge in a front-to-rear direction along the top portion 130. In another example, the toe-side integral rib 538 and heel-side integral rib 539 may converge in a front-to-rear direction along the top portion 130. In yet another example, a toe-side integral rib 538 and a heel-side integral rib 539 may converge and then diverge in a front-to-rear direction along the top portion 130. In another example, the toe-side integral rib 538 and heel-side integral rib 539 may be substantially parallel in a front-to-rear direction along the top portion 130. The toe-side rib 538 may include one or more curved portions along its length. Similarly, the heel-side rib 539 may include one or more curved portions along its length. The apparatus, methods, and articles of manufacture described herein are not limited in this regard.

An outer surface of the top portion 130 may have an anti-glare finish. An outer surface of the top portion 130 may have a medium or low gloss appearance to reduce the amount of light reflected upward at an individual's eyes when aligning the golf club head 100 with a golf ball and performing a golf shot. A relative gloss value may be determined by projecting a beam of light at a fixed intensity and angle onto the outer surface of the top portion 130 and measuring the amount of light reflected at an equal but opposite angle upward at the individual. On a measurement scale, a specular reflectance of 0 gloss units (GU) may be associated with a perfectly matte surface, and a specular reflectance of 100 GU may be associated with a highly polished black glass material. Providing a top portion 130 with a relatively low specular reflectance may be desirable to reduce distraction perceived by the individual of the golf club head 100, which may reduce mishits and thereby improve performance. In one example, an outer surface of the top portion 130 may have a specular reflectance of less than 55 GU. In another example, the outer surface of the top portion 130 may have a specular reflectance of less than 40 GU. In yet another example, the outer surface of the top portion 130 may have a specular reflectance of less than 25 GU. In still another example, the outer surface of the top portion 130 may have a specular reflectance of less than 10 GU. While the above examples may describe particular specular reflectance, the apparatus, methods, and article of manufacture may include the outer surface of the top portion 130 with a specular reflectance greater than or equal to 55 GU. The apparatus, methods, and articles of manufacture described herein are not limited in this regard.

In some examples, the outer surface of the top portion 130 may include an antireflective coating 133. In one example, the antireflective coating 133 may have a specular reflectance of less than 55 GU. In another example, the antireflective coating 133 may have a specular reflectance of less than 40 GU. In yet another example, the antireflective coating 133 may have a specular reflectance of less than 25 GU. In still another example, the antireflective coating 133 may have a specular reflectance of less than 10 GU. The apparatus, methods, and articles of manufacture described herein are not limited in this regard.

Figure 6:
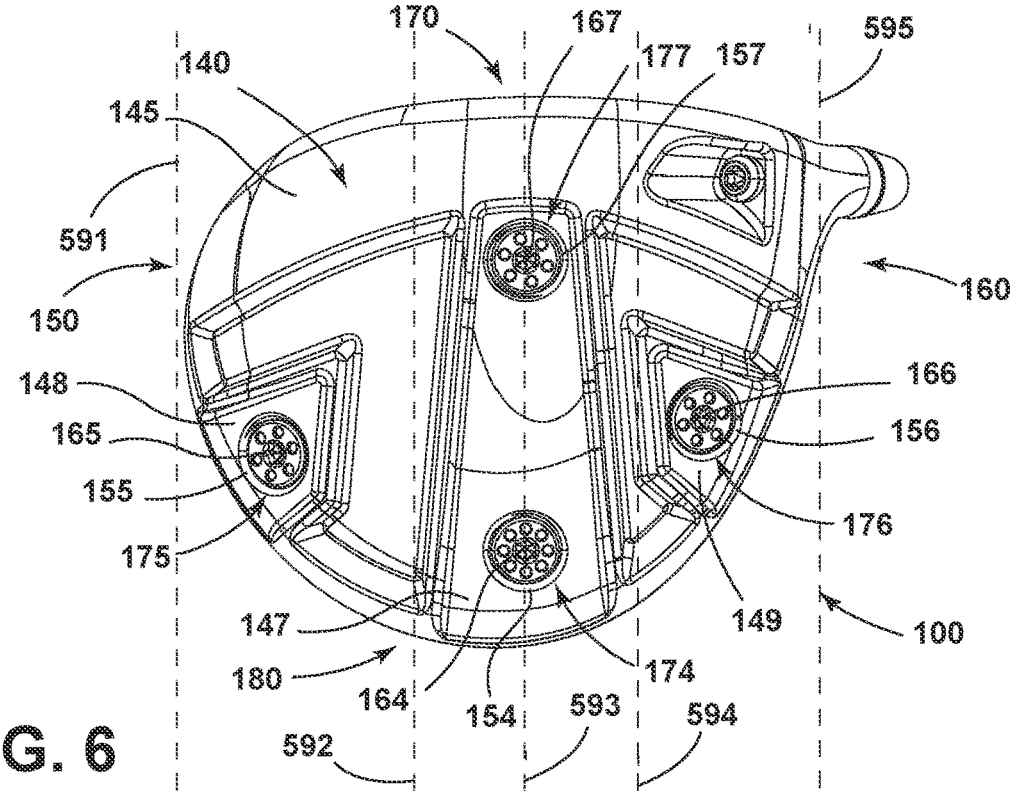
FIG. 6 is a bottom view of the golf club head of FIG. 1.

The golf club head 100 may include a plurality of weigh port regions. Each weight port region may include a weight port. Each weight port may include a weight. As shown in FIG. 6, a first weight port region 174 may be located closer to the rear portion 180 than the front portion 170. A second weight port region 175 may be located closer to the toe portion 150 than the heel portion 160. A third weight port region 176 may be located closer to the heel portion 160 than the toe portion 150. A fourth weight port region 177 may be located closer to the front portion 170 than the rear portion 180. The apparatus, methods, and articles of manufacture described herein are not limited in this regard.

The first weight port region 174 may include a first weight port 154 containing a first weight portion 164. The second weight port region 175 may include a second weight port 155 containing a second weight portion 165. The third weight port region 176 may include a third weight port 156 containing a third weight portion 166. The fourth weight port region 177 may include a fourth weight port 157 containing a fourth weight portion 167. The apparatus, methods, and articles of manufacture described herein are not limited in this regard.

The set of weight portions (e.g., generally shown as weight portions 164, 165, 166, and 167) may have similar or different masses. By using weight portions having similar or different masses in each of the weight ports, the overall mass in a weight port region and/or the mass distribution in the weight port regions may be adjusted to generally optimize and/or adjust the swing weight, center of gravity, moment of inertia, and/or an overall feel of the golf club head 100 for an individual using the golf club head 100. In one example, the set of weight portions may collectively have a mass of at least 8 grams. In another example, the set of weight portions may collectively have a mass of at least 12 grams. In yet another example, the set of weight portions may collectively have a mass of between and including 8 grams and 13 grams. In still yet another example, the set of weight portions may collectively have a mass of between and including 12 grams and 16 grams. In still yet another example, the set of weight portions may collectively have a mass of between and including 15 grams and 19 grams. In still yet another example, the set of weight portions may collectively have a mass of between and including 18 grams and 22 grams. While the above examples may describe particular masses, the apparatus, methods, and articles of manufacture described herein may include the set of weight portions to have an aggregate mass of less than 8 grams or an aggregate mass of greater than 19 grams. The apparatus, methods, and articles of manufacture described herein are not limited in this regard.

The bottom portion 140 of the golf club head 100 may have in inner surface 142 and an outer surface 145. The golf club head 100 may include one or more raised portions protruding outward from the outer surface 145. Each raised portion may include a weight port region. Each weight port region may include a weight port. Each weight port may include a weight portion. The apparatus, methods, and articles of manufacture described herein are not limited in this regard.

Figure 2:
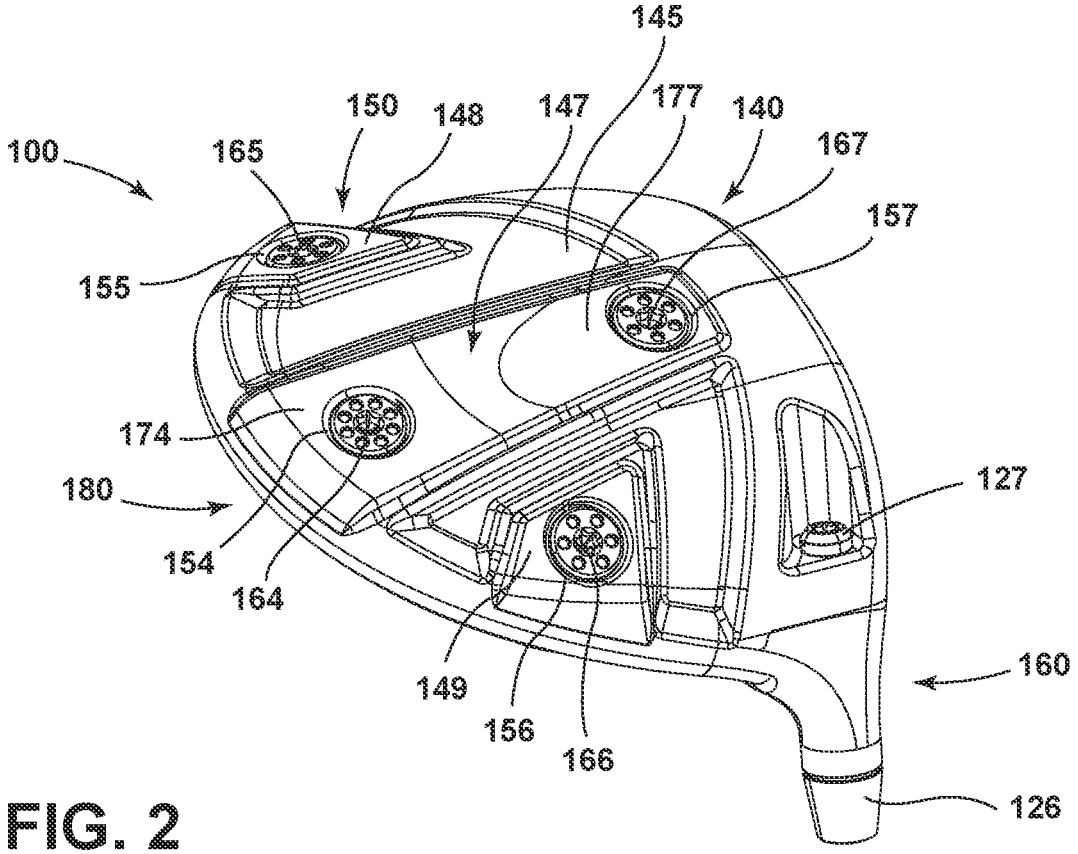
FIG. 2 is a bottom perspective view of the golf club head of FIG. 1.
Figure 3:
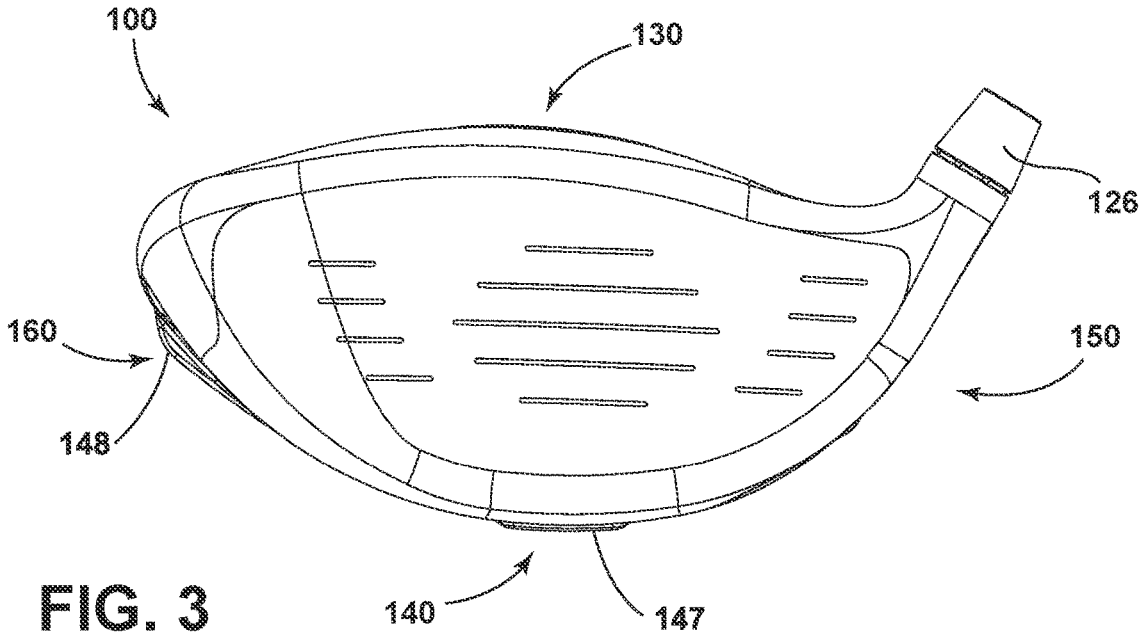
FIG. 3 is a front view of the golf club head of FIG. 1.
Figure 4:
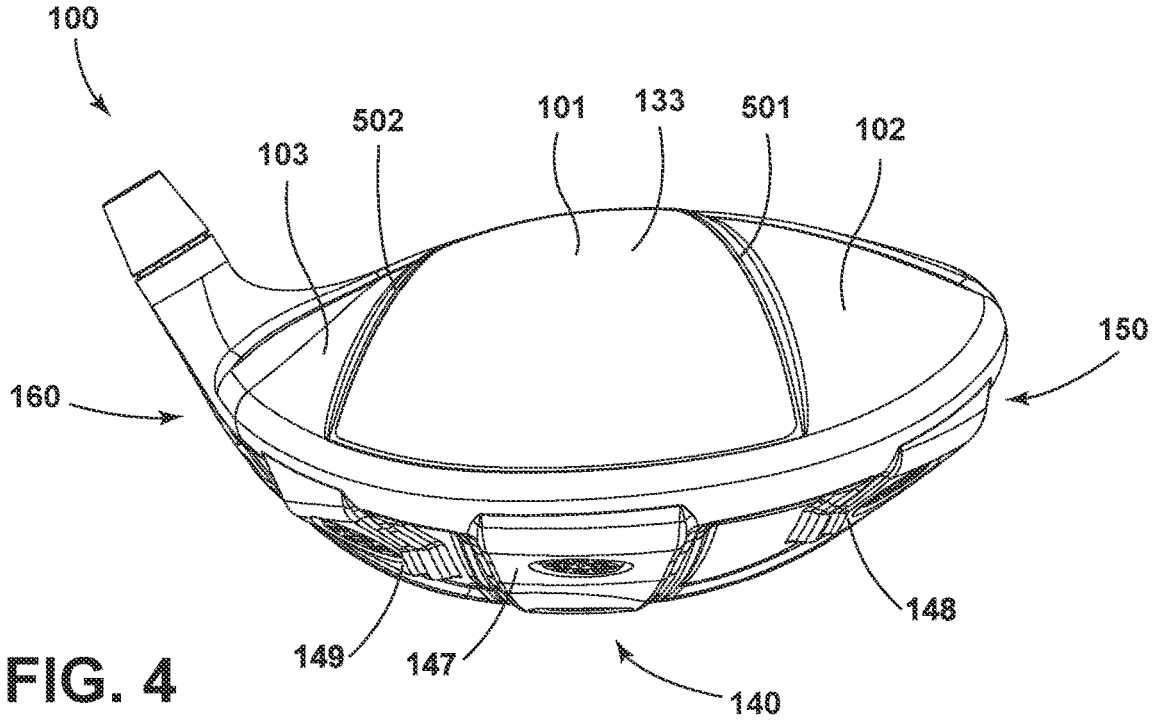
FIG. 4 is a rear view of the golf club head of FIG. 1.

The golf club head 100 may include a central protrusion 147 extending from the outer surface 145 of the bottom portion 140. The central protrusion 147 may extend from the rear portion 180 toward the front portion 170, as shown in FIG. 2. The central vertical plane 593 may pass through the central protrusion 147. The central vertical plane 593 may bisect the central protrusion 147. The central protrusion 147 may be located between the toe-side dividing plane 592 and the heel-side dividing plane 594, as shown in FIG. 6. The central protrusion 147 may include the first weight port region 174. The central vertical plane 593 may pass through the first weight port 154 and the first weight portion 164. The central vertical plane 593 may bisect the first weight port 154 and the first weight portion 164. The central protrusion 147 may include the fourth weight port region 177. The central vertical plane 593 may pass through the fourth weight port 157 and the fourth weight portion 167. The central vertical plane 593 may bisect the fourth weight port 157 and the fourth weight portion 167. The central protrusion 147 may allow placement of weight portions (e.g. 164, 167) a greater distance from a center point of the golf club head 100 to increase perimeter weighting and MOI without increasing club head volume. The apparatus, methods, and articles of manufacture described herein are not limited in this regard.

The golf club head 100 may include a toe-side protrusion 148 extending from the outer surface 145 of the bottom portion 140. The toe-side protrusion 148 may be located between the toe-side dividing plane 592 and the toe-side bounding plane 591. The toe-side protrusion 148 may be located closer to the rear portion 180 than the front portion 170. The toe-side protrusion 148 may include the second weight port region 175. The toe-side protrusion 148 may allow placement of the weight portion 165 a greater distance from the center point of the golf club head 100 to increase perimeter weighting and MOI without increasing club head volume. The apparatus, methods, and articles of manufacture described herein are not limited in this regard.

The golf club head 100 may include a heel-side protrusion 149 extending from the outer surface 145 of the bottom portion 140. The heel-side protrusion 149 may be located between the heel-side dividing plane 594 and the heel-side bounding plane 595. The heel-side protrusion 149 may be located closer to the rear portion 180 than the front portion 170. The heel-side protrusion 149 may include the third weight port region 176. The heel-side protrusion 149 may allow placement of the weight portion 166 a greater distance from the center point of the golf club head 100 to increase perimeter weighting and MOI without increasing club head volume. The apparatus, methods, and articles of manufacture described herein are not limited in this regard.

The golf club head 100 may include an insert 1350. The insert 1350 may be a vibration-dampening insert. The insert 1350 may be a sound-enhancing insert that attenuates certain frequencies. The insert 1350 may include a filler material. As shown in FIG. 9, the insert 1350 may be located on the inner surface 142 of the bottom portion 140 of the golf club head 100. The insert 1350 may be adjacent to one or more of the weight port regions. The insert 1350 may surround one or more of the weight ports. The insert 1350 may abut one or more of the weight port regions. The insert 1350 may abut the third weight port region 176. The insert 1350 may be closer to the heel portion 160 than the toe portion 150. The apparatus, methods, and articles of manufacture described herein are not limited in this regard.

Figure 10:
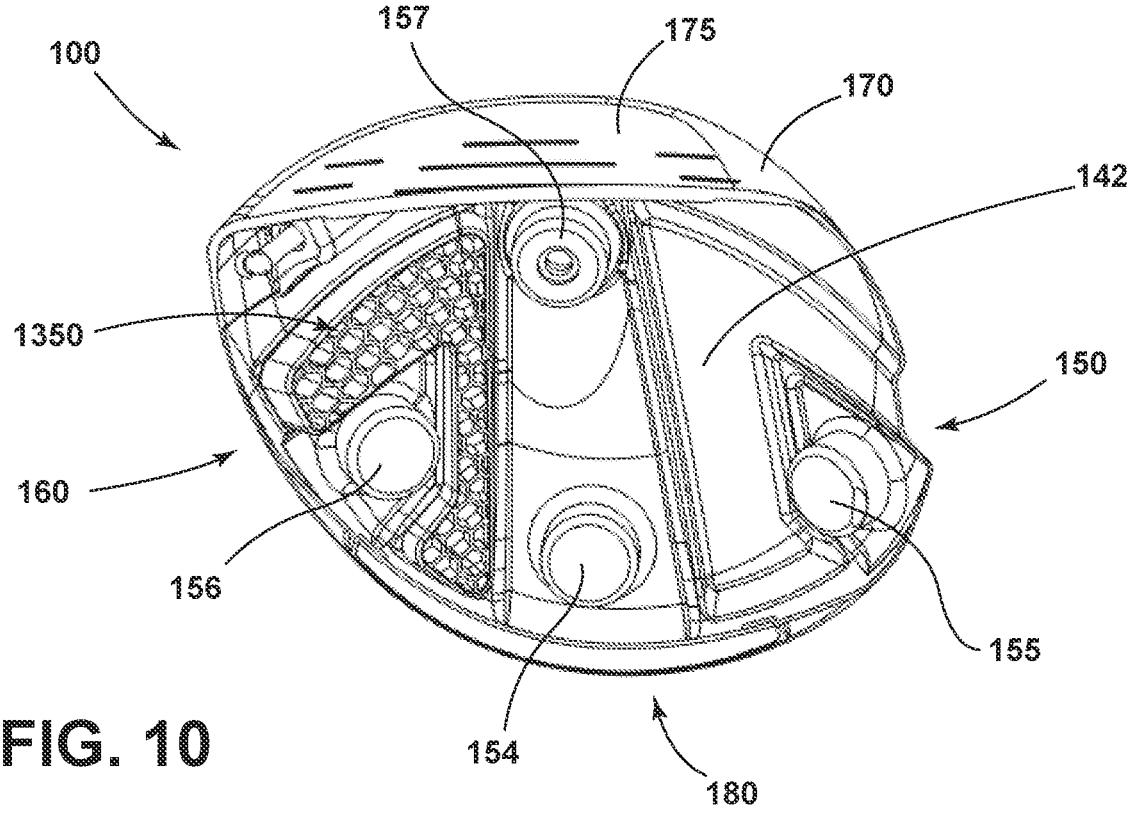
FIG. 10 is a cross-sectional view of the golf club head of FIG. 1 taken along section 10-10 of FIG. 8.
Figure 11:
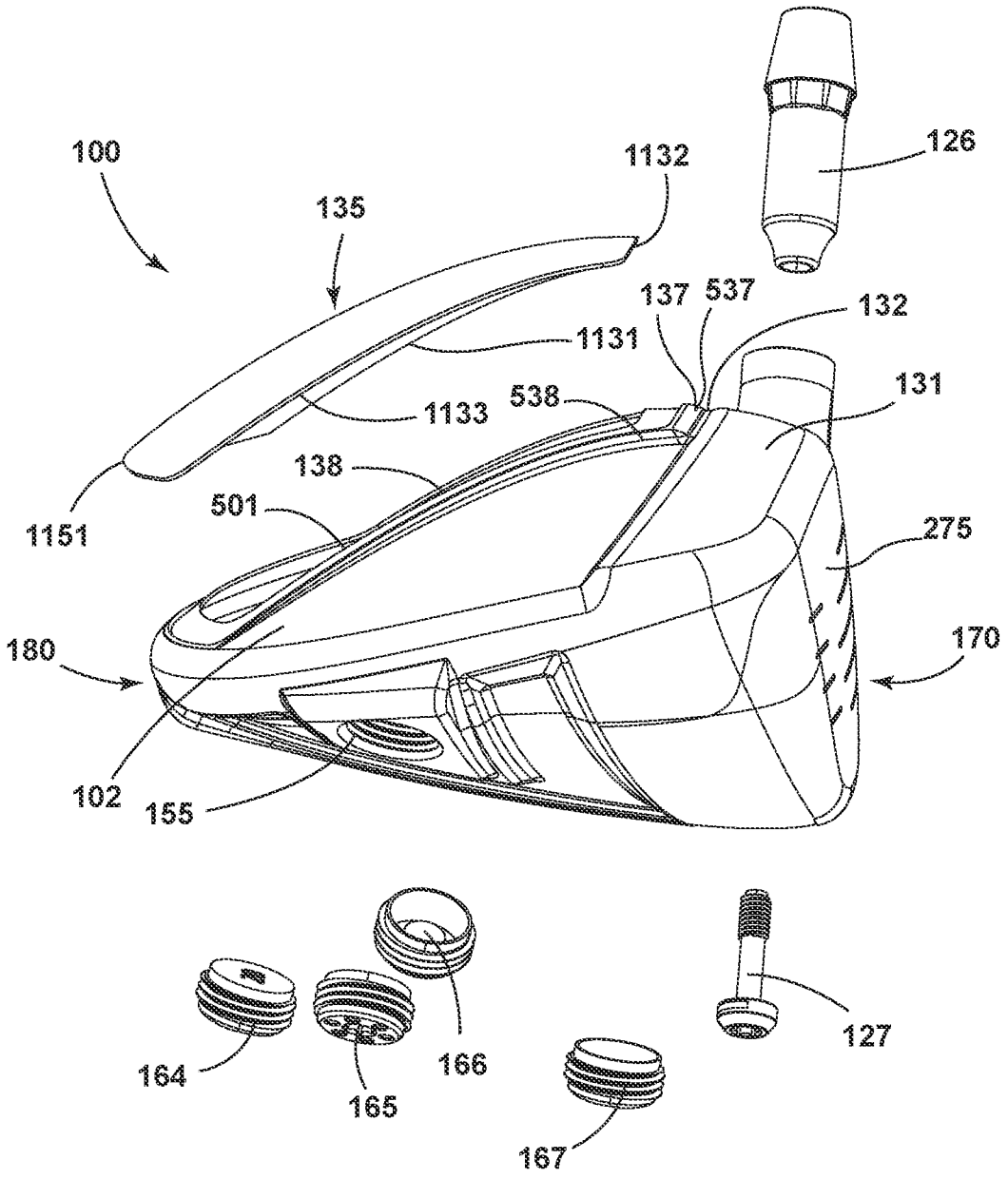
FIG. 11 is an exploded toe side view of the golf club head of FIG. 1.

The insert 1350 may be located between the central vertical plane 593 and the heel-side bounding plane 595. The insert 1350 may be located between the heel-side dividing plane 594 and the heel-side bounding plane 595. The insert 1350 may be located between the central protrusion 147 and the heel-side bounding plane 595. The insert 1350 may be located between the heel-side integral rib 539 and the inner surface 142 of the bottom portion 140. The insert 1350 may extend from a front side of the third weight port 156 to a rear side of the third weight port, as shown in FIG. 10. The insert 1350 may surround or partially surround the third weight port 156. The insert 1350 may include a plurality of hexagonal recesses. The hexagonal recesses may define a honeycomb pattern. The apparatus, methods, and articles of manufacture described herein are not limited in this regard.

The filler material described herein may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont' High-Performance Resin (HPF) family of materials (e.g., DuPont™ HPF AD1172, DuPont' HPF AD1035, DuPont® HPF 1000 and DuPont™ HPF 2000), which are manufactured by E.I. du Pont de Nemours and Company of Wilmington, Del. The DuPont' HPF family of ethylene copolymers are injection moldable and may be used with conventional injection molding equipment and molds, provide low compression, and provide high resilience. The apparatus, methods, and articles of manufacture described herein are not limited in this regard.

In the example of FIGS. 14-21, a golf club head 1400 may include a body portion 1410 with a top portion 1430, a crown portion 1435, a bottom portion 1440, a toe portion 1450, a heel portion 1460, a front portion 1470, and a rear portion 1480. The top portion 1430 and the crown portion 1435 may be similar in many respects to the top portion 130 and the crown portion 135 of FIGS. 1-13. The body portion 1410 may include a periphery 1490 defined as a side portion of the golf club head 1400 between the top portion 1430 and the bottom portion 1440 and extending around the body portion 1410 from the toe portion 1450, around the rear portion 1480, and to the heel portion 1460. The front portion 1470 may include a face portion 1475 for impacting a golf ball. The face portion 1475 may be integral to the body portion 1410 or may be a separate face portion that is coupled (e.g., welded) to the front portion 1470 to close an opening in the front portion 1470. The body portion 1410 may also include a hosel portion 1476 configured to receive a shaft portion 1474 (e.g., FIG. 17). The hosel portion 1476 may be similar in many respects to any of the hosel portions described herein. The hosel portion 1476 may be attached to the body portion 1410 via a fastener 1479. Alternatively, the body portion 1410 may include a bore configured to receive a shaft portion 1474 instead of the hosel portion 1476. The body portion 1410 may be made partially or entirely of an aluminum-based material, a magnesium-type material, a steel-based material, a titanium-based material, any combination thereof, or any other suitable material. In another example the body portion 1410 may be made partially or entirely of a non-metal material such as a ceramic material, a composite material, any combination thereof, or any other suitable material. The configuration of the body portion 1410 and/or the materials of construction of the body portion 1410 may be similar to the body portion and/or the materials of construction of any of the golf club heads described herein or in any of the incorporated by reference applications. The apparatus, methods, and articles of manufacture described herein are not limited in this regard.

The golf club head 1400 may include a plurality of weight ports at the bottom portion 1440, which are shown in the illustrated example of FIGS. 14-21 as a first weight port 1501, a second weight port 1502, a third weight port 1503, and a fourth weight port 1504. In one example, as illustrated in FIGS. 14-21, the first weight port 1501 may be located at or proximate to the front portion 1470, the second weight port 1502 may be located at or proximate to the toe portion 1450, the third weight port 1503 may be located at or proximate to the heel portion 1460, and the fourth weight port 1504 may be located at or proximate to the rear portion 1480. In one example, the plurality of weight ports may be threaded cylindrical ports of similar circumference and depth. One or more of the plurality of weight ports (e.g., the first weight port 1501 and the fourth weight port 1504) may communicate with an interior cavity 1411 of the golf club head 1400 via one or more openings (e.g., openings 1841 and 1842) through which an adhesive (not shown) may be applied to interior structures of the body portion 1410. The adhesive may be applied via a hot melt process and may function to improve feel, dampen sound, collect debris, and/or add weight to the golf club head 1400 at certain locations in the interior cavity 1411. In another example, the interior cavity 1411 may be partially or fully filled with one or more polymer materials via the openings 1841 and 1842. In yet another example, the interior cavity 1411 may include one or more filler inserts coupled to the interior walls of the body portion 1410. The configuration of the weight ports and presence, insertion, or injection of any adhesives and/or filler materials in the interior cavity may be similar in many respects to the weight ports, adhesives, and/or filler materials of any of the golf club heads described herein or described in any of the incorporated by reference applications. The apparatus, methods, and articles of manufacture described herein are not limited in this regard.

In the example of FIGS. 14-21, the golf club head 1400 may be characterized by a vertical plane system while at an address position. The vertical plane system may include a plurality of parallel vertical planes shown as a longitudinal vertical plane 1510, a toe-side bounding plane 1511, a heel-side bounding plane 1512, a toe-side dividing plane 1513, and a heel-side dividing plane 1514. The vertical plane system may also include a lateral vertical plane 1515 perpendicular to each of the plurality of parallel vertical planes. The longitudinal vertical plane 1510 may bisect the golf club head 1400 and may intersect a geometric center (e.g., at or proximate to a "sweet spot" of the golf club head 1400) on the face portion 1475. The toe-side bounding plane 1511 may be parallel with the longitudinal vertical plane 1510 and may bound a toe-side of the golf club head 1400 or may be tangent to the outermost extent of the of the toe side of the golf club head 1400. The heel-side bounding plane 1512 may be parallel with the longitudinal vertical plane 1510 and may bound a heel-side of the golf club head 1400 or may be tangent to the outermost extent of the of the heel side of the golf club head 1400. The toe-side dividing plane 1513 may be parallel with the longitudinal vertical plane 1510 and may be equidistant from the longitudinal vertical plane 1510 and the toe-side bounding plane 1511. The heel-side dividing plane 1514 may be parallel with the longitudinal vertical plane 1510 and may be equidistant from the longitudinal vertical plane 1510 and the heel-side bounding plane 1512. The lateral vertical plane 1515 may be located halfway between the frontmost and rearmost extents of the body portion 1410. The apparatus, methods, and articles of manufacture described herein are not limited in this regard.

In one example, the first and fourth weight ports 1501 and 1504 may be bisected by the longitudinal vertical plane 1510 and may be located between the toe-side dividing plane 1513 and the heel-side dividing plane 1514. The second weight port 1502 may be located between the toe-side bounding plane 1511 and the toe-side dividing plane 1513. The third weight port 1503 may be located between the heel-side bounding plane 1512 and the heel-side dividing plane 1514. The first, second, and third weight ports 1501, 1502, and 1503 may be located at a forward portion 641 of the bottom portion 1440. The fourth weight port 1504 may be located at a rear protrusion 1442 located at or proximate the rear portion 1480. The rear protrusion 1442 may intersect the longitudinal vertical plane 1510 and may be located between the toe-side dividing plane 1513 and the heel-side dividing plane 1514. The rear protrusion 1442 may project downward from the periphery 1490 and may extend along the longitudinal vertical plane 1510. In one example, as illustrated in FIGS. 14-21, the rear protrusion 1442 may be wedge shaped and may extend longitudinally in a rear-to-front direction from the rear portion 1480 toward the front portion 1470. The rear protrusion 1442 may end short of the lateral vertical plane 1515. In another example, the rear protrusion 1442 may extend in the rear-to-front direction and end at the lateral vertical plane 1515 or may intersect and extend past the lateral vertical plane 1515. A width of the rear protrusion 1442 may vary or be uniform in a rear-to-front direction. In one example, as illustrated in FIGS. 14-21, the rear protrusion 1442 may decrease in width in the rear-to-front direction. In another example, the rear protrusion 1442 may have a uniform width in the rear-to-front direction. In yet another example, the rear protrusion 1442 may have an increase in width in the rear-to-front direction. In one example, as illustrated in FIGS. 14-21, the rear protrusion 1442 may decrease in height in the rear-to-front direction. In another example, the rear protrusion 1442 may have a uniform height in the rear-to-front direction. In yet another example, the rear protrusion 1442 may have an increase in height in the rear to front direction. The apparatus, methods, and articles of manufacture described herein are not limited in this regard.

In the example of FIGS. 14-21, a set of weight portions shown as a first weight portion 1505, a second weight portion 1506, a third weight portion 1507, and a fourth weight portion 1508 may be coupled to the plurality of weight ports. In one example, the first weight portion 1505 may be coupled to the first weight port 1501, the second weight portion 1506 may be coupled to the second weight port 1502, the third weight portion 1507 may be coupled to the third weight port 1503, and the fourth weight portion 1508 may be coupled to the fourth weight port 1504. The set of weight portions may have similar or different masses to generally optimize and/or adjust the swing weight, center of gravity, moment of inertia, and/or an overall feel of the golf club head 1400 for an individual using the golf club head 1400. The set of weight portions may individually and/or collectively have a mass similar to any of the weight portion masses described herein with respect to other example golf club heads (e.g., golf club head 100). In one example, the set of weight portions may be interchangeable and may have similar or different masses. The configuration of the weight portions and the coupling thereof to the weight ports may be similar in many respects to the weight portions and the weight ports of any of the golf club heads described herein or described in any of the incorporated by reference applications. The apparatus, methods, and articles of manufacture described herein are not limited in this regard.

In the example of FIGS. 14-21, the bottom portion 1440 of the golf club head 1400 may include a recessed portion 1520 located rearward of the first weight port 1501, the second weight port 1502 and the third weight port 1503. With respect to the rear-to-front direction, a greater portion (e.g., greater than 50%) of the recessed portion 1520 may be located rearward of the lateral vertical plane 1515. With respect to a toe-to-heel direction, a greater portion of the recessed portion 1520 may be located toe-ward of the longitudinal vertical plane 1510. The recessed portion 1520 may have a perimeter defined by the rear protrusion 1442 and a plurality of contoured transition regions exemplarily shown as a first contoured transition region 1521, a second contoured transition region 1522, a third contoured transition region 1523, a fourth contoured transition region 1524, and a fifth contoured transition region 1525. Any of the plurality of contoured transition regions may be linear, curved, curvilinear, and/or have any other shape. Any of the plurality of contoured transition regions may have single stepped (e.g., a single wall), multiple stepped or gradual transitions. In one example, as illustrated in FIGS. 14-21, the first contoured transition region 1521 may be located rearward of the first weight port 1501 and may be positioned adjacent or proximate to the first weight port 1501. The first contoured transition region 1521 may be bisected by the longitudinal vertical plane 1510 and may be located forward of the lateral vertical plane 1515. The first contoured transition region 1521 may extend linearly in a lateral direction between the toe-side dividing plane 1513 and the heel-side dividing plane 1514 and may be parallel to the lateral vertical plane 1515. In the illustrated example of FIGS. 14-21, the second contoured transition region 1522 may extend linearly from the first contoured transition region 1521 in a rearward diagonal direction toward the toe portion 1450. In the illustrated example of FIGS. 14-21, the second contoured transition region 1522 may extend from the first contoured transition region 1521 to a location rearward of the second weight port 1502 and adjacent or proximate to the second weight port 1502. The second contoured transition region 1522 may intersect the lateral vertical plane 1515 and the toe-side dividing plane 1513 and may extend up to the periphery 1490 of the body portion 1410. The third contoured transition region 1523 may extend linearly from the first contoured transition region 1521 in a rearward diagonal direction toward the heel portion 1460. In the illustrated example of FIGS. 14-21, the third contoured transition region 1523 may extend from the first contoured transition region 1521 to a location rearward of the third weight port 1503 and adjacent or proximate to the third weight port 1503. The third contoured transition region 1523 may intersect the lateral vertical plane 1515 and the heel-side dividing plane 1514 and may extend up to the periphery 1490 of the body portion 1410. The first and second contoured transition regions 1521 and 1522 may be joined to define a first elbow 1526 and the first and third contoured transition regions 1521 and 1523 may be joined to define a second a second elbow 1527. In one example, the first and second elbows 1526 and 1527 may point in a forward direction (e.g., toward the face portion 1475). In such an arrangement, the first contoured transition region 1521 may be set further back, forming a pocket structure, to allow the first weight port 1501 to be positioned further rearward and closer to a center portion 647 of the bottom portion 1440. In so doing, the first weight portion 1505 may lower the center of gravity (CG) of the golf club head 1400. In another example, the first and second elbows 1526 and 1527 may point in a rearward direction (e.g., toward the rear portion 1480). The apparatus, methods, and articles of manufacture described herein are not limited in this regard.

In the example of FIGS. 14-21, the fourth contoured transition region 1524 may extend between the longitudinal vertical plane 1510 and the toe-side bounding plane 1511. The fourth contoured transition region 1524 may be located rearward of the lateral vertical plane and may intersect the toe-side dividing plane 1513. In one example, as illustrated in FIGS. 14-21, the fourth contoured transition region 1524 may extend curvilinearly from the second contoured transition region 1522 in a rearward direction about the periphery 1490 and may adjoin a toe-side portion 1444 of the rear protrusion 1442. Accordingly, the fourth contoured transition region 1524 may define or partially define a rear-toe portion 1491 of the periphery 1490 of the body portion 1410. In one example, as illustrated in FIGS. 14-21, the fifth contoured transition region 1525 may extend between the longitudinal vertical plane 1510 and the heel-side bounding plane 1512. The fifth contoured transition region 1525 may be located rearward of the lateral vertical plane 1515 and may intersect the heel-side dividing plane 1514. In one example, the fifth contoured transition region 1525 may extend curvilinearly from the third contoured transition region 1523 in a rearward direction about the periphery 1490 and may adjoin a heel-side portion 1445 of the rear protrusion 1442. Accordingly, the fifth contoured transition region 1525 may define or partially define a rear-heel portion 1492 of the periphery 1490 of the body portion 1410. The heel-side portion 1445 and the toe-side portion 1444 of the rear protrusion 1442 may be joined together by a front-side portion 1446 of the rear protrusion 1442. In one example, as illustrated in FIGS. 14-21, the front-side portion 1446 of the rear protrusion 1442 and the first contoured transition region 1521 may be arranged in parallel to face one another and may extend a same distance laterally across the bottom portion 1440. The apparatus, methods, and articles of manufacture described herein are not limited in this regard.

In the illustrated example of FIGS. 14-21, the perimeter of the recessed portion 1520 may define an opening 1528 leading into the interior cavity 1411 of the golf club head 1400. The recessed portion 1520 may further include a shoulder portion 1529 extending inward toward the opening 1528 and adjoined to the perimeter of the recessed portion 1520 or a portion(s) of the recessed portion 1520. In one example, the shoulder portion 1529 may be adjoined to the first contoured transition region 1521, the second contoured transition region 1522, the third contoured transition region 1523, the fourth contoured transition region 1524, the fifth contoured transition region 1525, and the rear protrusion 1442 (e.g., the toe-side portion 1444, the heel-side portion 1445, and the front-side portion 1446). The shoulder portion 1529 may be configured as a ledge structure and may extend a certain distance inward into the opening 1528. In one example, the shoulder portion 1529 may extend into the opening by a distance of greater than or equal to 2 millimeters (mm) and less than or equal to 4 mm. In another example, the shoulder portion 1529 may extend into the opening by a distance of greater than or equal to 4 mm and less than or equal to 6 mm. In another example, the shoulder portion 1529 may extend into the opening by a distance of greater than or equal to 6 mm and less than or equal to 8 mm. In another example, the shoulder portion 1529 may extend into the opening by a distance of greater than or equal to 2 mm and less than or equal to 5 mm. In yet another example, the shoulder portion 1529 may extend into the opening by a distance of greater than or equal to 3 mm and less than or equal to 9 mm. The apparatus, methods, and articles of manufacture described herein are not limited in this regard.

Figure 20:
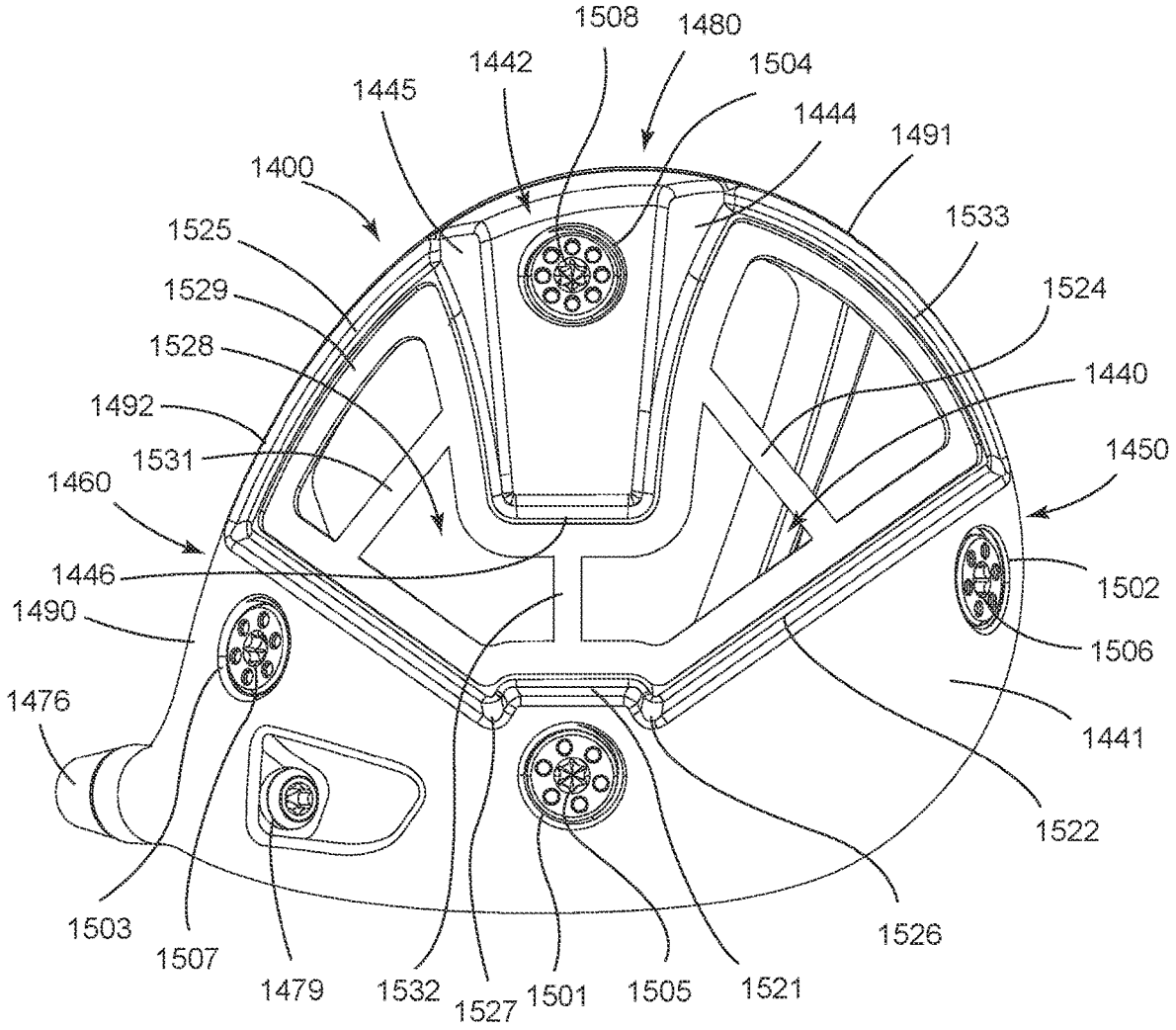
FIG. 20 is a bottom view of the golf club head of FIG. 14 with a sole insert portion removed to illustrate another example of a bottom portion of the golf club head.
Figure 21:
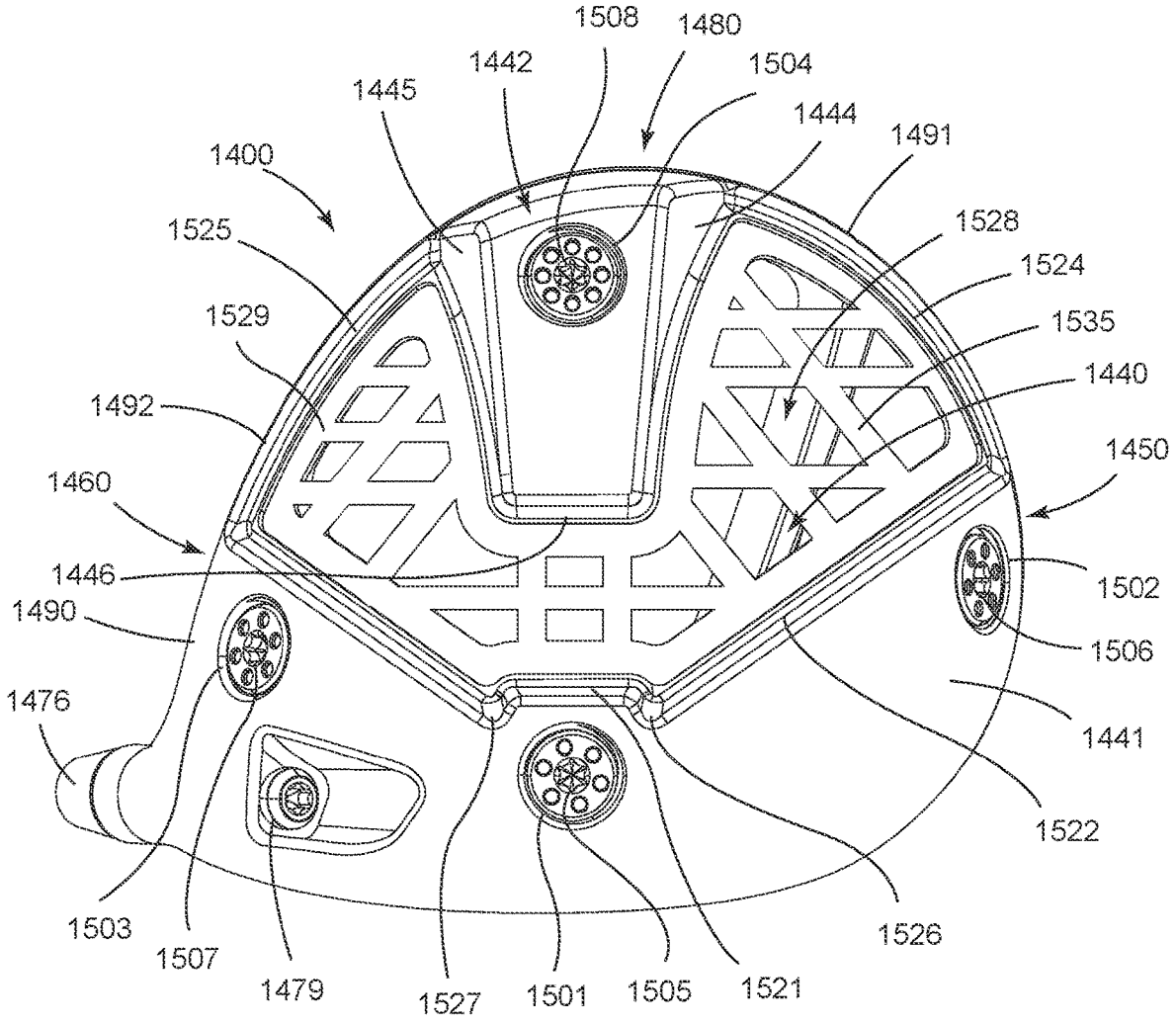
FIG. 21 is a bottom view of the golf club head of FIG. 14 with the sole insert portion removed to illustrate yet another example of the bottom portion of the golf club head.

As described herein, the shoulder portion 1529 may be a continuous or discontinuous support structure encircling the entire opening 1528 or a portion thereof. In one example, as illustrated in FIGS. 14-19, opposing portions of the opening 1528 may not be connected by any structures (i.e., the opening may be unobstructed). In another example, as illustrated in FIG. 20, the shoulder portion 1529 may include one or more connecting members (e.g., shown as connecting members 1531, 1532, and 1533) that extend across the opening 1528 and adjoin opposing portions of the shoulder portions 1529. In another example, as shown in FIG. 21, the shoulder portion 1529 may be configured as a plurality of interconnected and intersecting support ribs 1535 or support structures defining a lattice. In another example (not shown), the shoulder portion 1529 may be configured as a mesh. In yet another example (not shown), the shoulder portion 1529 may be configured as discrete support structures such as a plurality of equal and/or variable length tabs that may be arranged around the opening in an equidistant or variable spacing configuration. The apparatus, methods, and articles of manufacture described herein are not limited in this regard.

In the example of FIGS. 14-21, the recessed portion 1520 may further include a sole insert portion 1540 coupled (e.g., adhered) to the shoulder portion 1529 to cover the opening 1528. The sole insert portion 1540 may be asymmetric about the longitudinal vertical plane 1510 and may extend between the toe portion 1450 and the heel portion 1460. The sole insert portion 1540 may be recessed relative to the forward portion 641 and may include a central intermediate portion 1541 located between the first contoured transition region 1521 and the front-side portion 1446 of the rear protrusion 1442. The sole insert portion 1540 may also include a first wing portion 1542 connected to the central intermediate portion 1541 and located between the second contoured transition region 1522, the fourth contoured transition region 1524, and the toe-side portion 1444 of the rear protrusion 1442. The first wing portion 1542 may fan out or increase in outer surface area in a rearward direction from the central intermediate portion 1541 toward the rear-toe portion 1491 of the periphery 1490. The sole insert portion 1540 may further include a second wing portion 1543 connected to the central intermediate portion 1541 and located between the third contoured transition region 1523, the fifth contoured transition region 1525, and the heel-side portion 1445 of the rear protrusion 1442. The second wing portion 1543 may fan out or increase in outer surface area in a direction from the central intermediate portion 1541 toward the rear-heel portion 1492 of the periphery 1490. In one example, the first wing portion 1542 may have a larger outer surface area than the second wing portion 1543, which may in turn have a larger outer surface area than the central intermediate portion 1541. In another example, the first wing portion 1542 may have a smaller outer surface area than the second wing portion 1542. In yet another example, the first wing portion 1542 and the second wing portion 1542 may have about the same outer surface area. The first and second wing portions 1542 and 1543 may be configured in a variety of shapes that increase in outer surface toward the toe portion 1450 and the heel portion 1460, respectively. In one example, as illustrated in FIGS. 14-21, the sole insert portion 1540 may be a unitary structure. In another example, the sole insert portion 1540 may be defined by two or more separate structures. For example, the central intermediate portion 1541, the first wing portion 1542, and the second wing portion 1543 may each be provided as separate pieces. The apparatus, methods, and articles of manufacture described herein are not limited in this regard.

In the example of FIGS. 14-21, the sole insert portion 1540 may define greater than 30% and less than 40% of a total outer surface area of the bottom portion 1440. In another example, the sole insert portion 1540 may define greater than 25% and less than 50% of the total outer surface area of the bottom portion 1440. In yet another example, the sole insert portion 1540 may define greater than 20% and less than 60% of the total outer surface area of the bottom portion 1440. The sole insert portion 1540 may have a total outer surface area that is greater than a total outer surface area of the rear protrusion 1442 and a total outer surface area of the forward portion 641 of the bottom portion 1440. The forward portion 1441 may be defined as the portion(s) of the bottom portion 1440 bounded by the first contoured transition region 1521, the second contoured transition region 1522, the third contoured transition region 1523, the front portion 1470 (e.g., the face portion 1475), and the top portion 1430. In one example, the sole insert portion 1540 may have a uniform or variable thickness ranging from 0.250 mm to 1.250 mm. In another example, any portion of the sole insert portion 1540 may have a thickness of greater than or equal to 0.1 mm and less than or equal to 1.0 mm. In yet another example, any portion of the sole insert portion 1540 may have a thickness of greater than or equal to 0.2 mm and less than or equal to 2.0 mm. The apparatus, methods, and articles of manufacture described herein are not limited in this regard.

The sole insert portion 1540 may be made from a material having a lower density than a density of one or more materials of certain or all portions of the body portion 1410 while providing sufficient stiffness or structural support for the bottom portion 1440. In one example, all or portions of the body portion 1410 may be constructed from steel and the sole insert portion 1540 may be constructed from titanium. In another example, all of portions of the body portion 1410 may be constructed from steel and the sole insert portion 1540 may be constructed from a composite material. In yet another example, all of portions of the body portion 1410 may be constructed from steel and the sole insert portion 1540 may be constructed from a polymer material. The presence of one or more connecting members (e.g., connecting members 1531 and 1532) or any structural support members in the opening 1528 may affect the physical properties and the materials of construction of the sole insert portion 1540. In one example, due to the presence of the connecting members 1531, 1532, and 1533 in the opening 1528 of the golf club head 1400 of FIG. 20, a sole insert portion 1540 for the golf club head 1400 of FIG. 20 may not have to provide as much structural support for the bottom portion 1440 as a sole insert portion 1540 for the golf club head 1400 of FIGS. 14-19. In another example, due to the presence of the mesh structure in the opening 1528 of the golf club head 1400 of FIG. 21, a sole insert portion 1540 for the golf club head 1400 of FIG. 21 may not have to provide as much structural support for the bottom portion 1440 as a sole insert portion 1540 for the golf club head 1400 of FIG. 20. In yet another example, the mesh structure of the golf club head 1400 of FIG. 21 may provide sufficient structural support for the golf club head 1400 such that the sole insert portion 1540 may be constructed from a polymer material (e.g., thermoplastic or thermoset material). Thus, the materials of construction of the sole insert portion 1540 and other physical properties of the sole insert portion 1540 may be determined to provide optimal performance characteristics for the golf club head 1400 while structurally supporting the body portion 1410. The apparatus, methods, and articles of manufacture described herein are not limited in this regard.

In one example, as illustrated in FIGS. 14-21, the sole insert portion 1540 may be constructed from one or more layers of a composite material so as to have a lower density than the density of the body portion 1410 and provide sufficient structural support for the bottom portion 1440. A sole insert portion 1540 constructed from one or more composite materials may provide sound and vibration dampening for the golf club head 1400. Additionally, the mass savings provided by a sole insert portion 1540 constructed from one or more composite materials may provide an increase in a moment of inertia (MOI) of the golf club head 1400 by enabling more mass to be concentrated toward the periphery 1490 (e.g., via the set of weight portions). In one example, more mass may be concentrated toward the rear portion 1480 (e.g., via the fourth weight portion 1508) in effect increasing spin and imparting higher launch to a golf ball struck by the golf club head 1400. Accordingly, the golf club head 1400 may provide greater forgiveness to the benefit of most golfers. The apparatus, methods, and articles of manufacture described herein are not limited in this regard.

As described herein, the sole insert portion 1540 may include a single layer of composite material or a plurality of layers of composite material. The plurality of layers of composite materials may include different material and/or physical properties. In one example, the entire sole insert portion 1540 may include the same configuration of composite materials and/or layers. In another example, certain portions of the sole insert portion 1540 may include a greater number of composite material layers to provide additional stiffness (i.e., additional layers forming stiffening ribs) at certain locations on the sole insert portion. In one example, the sole insert portion 1540 may include one or more layers of composite material that may be arranged in parallel or substantially parallel planes. In another example, the sole insert portion 1540 may include one or more layers of composite material that may be arranged in nonparallel planes. The tensile strength of the sole insert portion 1540, as determined along certain axes, may be enhanced by having layers of composite material that are arranged in nonparallel planes (i.e., nonuniform orientations). The number of composite material layers of the sole insert portion 1540, the material and physical properties of each composite layer of the sole insert portion 1540, and/or construction of the sole insert portion 1540 may be similar in many respects to construction of composite golf club head parts (e.g., composite crown) of any of the golf club heads described herein or described in any of the incorporated by reference applications. The apparatus, methods, and articles of manufacture described herein are not limited in this regard.

The plurality of composite layers may include a plurality of layers of composite materials in a stacked arrangement. A layer of composite material may include a layer of fabric combined with an amount of resin. The fabric may be constructed from graphite fiber (commonly referred to as "carbon fiber"), glass fiber, aramid fiber, carbon nanotubes, or any other suitable high-performance fiber, combination of fibers, or material. In some examples, the fabric may be a hybrid of two or more types of fibers, such as a hybrid fabric made of carbon fibers and aramid fibers. Examples of aramid fibers include KEVLAR, TWARON, NOMEX, NEW STAR, TECHNORA, and TEIJINCONEX fibers. The fabric may be constructed as a woven, knitted, stitched, or nonwoven (e.g. uni-directional) fabric. Examples of suitable woven fabrics include Style 71525 Bi-directional E-Glass (Item No. 1094), Twill Weave Carbon Fiber Fabric (Item No. 1069), and KEVLAR Plain Weave Fabric (Item No. 2469), all available from Fibre Glast Developments Corporation of Brookville, Ohio. The resin may be a thermosetting resin, such as an epoxy resin, vinyl-ester resin, polyester resin, or other suitable resin. Resin selection may be based, at least in part, on fabric compatibility and the characteristics of the composite layers. Epoxy resins are suitable since they may be used to form a strong, lightweight composite sole insert portion 1540 that is dimensionally stable. A suitable epoxy resin is System 2000 Epoxy Resin (Item No. 2000-A) available from Fibre Glast Developments Corporation. The number of composite material layers of the sole insert portion 1540, the material and physical properties of each composite layer of the sole insert portion 1540, and/or construction of the sole insert portion 1540 may be similar in many respects to construction of composite golf club head parts (e.g., composite crown) of any of the golf club heads described herein or described in any of the incorporated by reference applications. The apparatus, methods, and articles of manufacture described herein are not limited in this regard.

Manufacturing and assembly of one or more parts of the golf club head 1400 including the weight portions and/or injection or placement of any filler materials in the interior cavity 1411 may be similar in many respects to the manufacturing and assembly of similar parts of any of the golf club heads described herein or described in any of the incorporated by reference applications. After manufacturing the body portion 1410, the sole insert portion 1540 may be adhered or otherwise affixed to the shoulder portion 1529. In one example, a sole insert portion 1540 that is constructed from a metal or metal alloy may be attached to the shoulder portion 1529 by one or more adhesives, one or more bonding agents, welding, soldering, mechanical locking, and/or one or more fasteners. In another example, as shown in FIGS. 14-21, a sole insert portion 1540 that is constructed from a composite material may be attached to the shoulder portion 1529 by one or more adhesives, one or more bonding agents, mechanical locking, and/or one or more fasteners. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters (cm3 or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type ofthe golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion comprising a front portion, a rear portion, a toe portion, a heel portion, a top portion, a bottom portion, and a periphery, the bottom portion comprising:

a forward portion;

a rear protrusion at or proximate the rear portion, the rear protrusion projecting downward from the periphery and extending longitudinally in a rear-to-front direction, the rear protrusion having a front-side portion, a toe-side portion, and a heel-side portion;

a first weight port at the forward portion and located at or proximate the front portion, the first weight port configured to receive a first weight portion;

a second weight port at the forward portion and located at or proximate the toe portion, the second weight port configured to receive a second weight portion;

a third weight port at the forward portion and located at or proximate the heel portion, the third weight port configured to receive a third weight portion;

a fourth weight port at the rear protrusion, the fourth weight port configured to receive a fourth weight portion;

a recessed portion separating the forward portion and the rear protrusion, the recessed portion comprising:

a plurality of contoured transition regions comprising:

a first contoured transition region located adjacent to the first weight port;

a second contoured transition region extending from the first contoured transition region in a rearward diagonal direction toward the toe portion, a portion of the second contoured transition region being adjacent to the second weight port;

a third contoured transition region extending from the first contoured transition region in a rearward diagonal direction toward the heel portion, a portion of the third contoured transition region being adjacent to the third weight port;

a fourth contoured transition region extending from the second contoured transition region in a rearward direction about the periphery and adjoining the toe-side portion of the rear protrusion;

a fifth contoured transition region extending from the third contoured transition region in a rearward direction about the periphery and adjoining the heel-side portion of the rear protrusion;

an opening defined by the plurality of contoured transition regions and the rear protrusion; and a sole insert portion coupled to the bottom portion to cover the opening.

2. A golf club head as defined in claim 1, wherein the rear protrusion is wedge shaped.

3. A golf club head as defined in claim 1, wherein the rear protrusion decreases in height and width in the rear-to-front direction.

4. A golf club head as defined in claim 1, wherein the sole insert portion defines greater than 20% and less than 60% of a total outer surface area of the bottom portion, and wherein the sole insert portion has a total outer surface area that is greater than a total outer surface are of the forward portion.

5. A golf club head as defined in claim 1 further comprising a shoulder portion adjoined to the plurality of contoured transition regions and the rear protrusion, the shoulder portion extending inward toward the opening, wherein the sole insert portion is coupled to the shoulder portion to cover the opening.

6. A golf club head as defined in claim 1, wherein the sole insert portion comprises:

a central intermediate portion located between the first contoured transition region and the front-side portion of the rear protrusion, the front-side portion and the first contoured transition region arranged in parallel to face one another and extending a same distance laterally across the bottom portion;

a first wing portion connected to the central intermediate portion and located between the second contoured transition region, the fourth contoured transition region, and the toe-side portion of the rear protrusion; and a second wing portion connected to the central intermediate portion and located between the third contoured transition region, the fifth contoured transition, and the heel-side portion of the rear protrusion, wherein the first wing portion has a greater outer surface area than the second wing portion, and wherein the second wing portion has a greater outer surface area than the central intermediate portion.

7. A golf club head as defined in claim 1, wherein the sole insert portion comprises:

a central intermediate portion having a uniform surface;

a first wing portion that increases in outer surface area in a rearward direction from the central intermediate portion toward the toe portion; and a second wing portion that increases in outer surface area in a rearward direction from the central intermediate portion toward the heel portion, wherein the central intermediate portion, the first wing portion, and the second wing portion have different outer surface areas.

8. A golf club head comprising:

a body portion comprising a front portion, a face portion at the front portion, a rear portion, a toe portion, a heel portion, a top portion, a bottom portion, and a periphery;

a vertical plane system characterizing the golf club head at an address position, the vertical plane system comprising:

a longitudinal vertical plane bisecting the golf club head and intersecting a geometric center of the face portion;

a toe-side bounding plane parallel with the longitudinal vertical plane and bounding a toe-side of the golf club head;

a heel-side bounding plane parallel with the longitudinal vertical plane and bounding a heel-side of the golf club head;

a toe-side dividing plane parallel with the longitudinal vertical plane and equidistant from the longitudinal vertical plane and the toe-side bounding plane;

a heel-side dividing plane parallel with the longitudinal vertical plane and equidistant from the longitudinal vertical plane and the heel-side bounding plane; and a lateral vertical plane perpendicular to the longitudinal vertical plane and located halfway between a frontmost extent and a rearmost extent of the body portion;

a forward portion at the bottom portion;

a rear protrusion at the bottom portion and located at or proximate the rear portion, the rear protrusion projecting downward from the periphery and extending longitudinally in a rear-to-front direction;

a plurality of contoured transition regions at the bottom portion and separating the forward portion and the rear protrusion, the plurality of contoured transition regions comprising:

a first contoured transition region extending laterally across the bottom portion, the first contoured transition region located forward of the lateral vertical plane and intersecting the longitudinal vertical plane;

a second contoured transition region extending from the first contoured transition region in a rearward diagonal direction toward the toe portion, the second contoured transition region extending between the longitudinal vertical plane and the toe-side bounding plane and intersecting the lateral vertical plane and the toe-side dividing plane;

a third contoured transition region extending from the first contoured transition region in a rearward diagonal direction toward the heel portion, the third contoured transition region extending between the longitudinal vertical plane and the heel-side bounding plane and intersecting the lateral vertical plane and the heel-side dividing plane;

a fourth contoured transition region extending from the second contoured transition region in a rearward direction about the periphery and adjoining the rear protrusion, the fourth contoured transition region located rearward of the lateral vertical plane and intersecting the toe-side dividing plane; and a fifth contoured transition region extending from the third contoured transition region in a rearward direction about the periphery and adjoining the rear protrusion, the fifth contoured transition region located rearward of the lateral vertical plane and intersecting the heel-side dividing plane;

an opening at the bottom portion and defined by the plurality of contoured transition regions and the rear protrusion; and a sole insert portion coupled to the bottom portion to cover the opening, wherein the forward portion is bounded by the first contoured transition region, the second contoured transition region, the third contoured transition region, the face portion, and the top portion, wherein the sole insert portion is recessed relative to the forward portion, wherein the sole insert portion extends between the toe portion and the heel portion, wherein more than 50% of the sole insert portion is located rearward of the lateral vertical plane, wherein more than 50% of the sole insert portion is located toe-ward of the longitudinal vertical plane, wherein the sole insert portion has a total outer surface area that is greater than a total outer surface area of the forward portion, and wherein the sole insert portion defines greater than 20% and less than 60% of a total outer surface area of the bottom portion.

9. A golf club head as defined in claim 8, wherein the rear protrusion is wedge shaped.

10. A golf club head as defined in claim 8 further comprising a shoulder portion adjoined to the plurality of contoured transition regions and the rear protrusion, the shoulder portion extending inward toward the opening to define a ledge structure, wherein the sole insert portion is coupled to the shoulder portion to cover the opening.

11. A golf club head as defined in claim 8, wherein the sole insert portion has a thickness ranging from 0.250 mm to 1.250 mm.

12. A golf club head as defined in claim 8, wherein the sole insert portion comprises a central intermediate portion extending between the first contoured transition region and the rear protrusion, a first wing portion that increases in surface area in a rearward direction from the central intermediate portion toward a rear-toe portion of the periphery, and a second wing portion that increases in surface area in a rearward direction from the central intermediate portion toward a rear-heel portion of the periphery.

13. A golf club head as defined in claim 8, wherein the sole insert portion comprises a central intermediate portion between the first contoured transition region and the rear protrusion, a first wing portion extending from the central intermediate portion toward a rear-toe portion of the periphery, and a second wing portion extending from the central intermediate portion toward a rear-heel portion of the periphery, wherein the first wing portion has a larger surface area than the second wing portion, and wherein the second wing portion has a larger surface area than the central intermediate portion.

14. A golf club head as defined in claim 8, wherein the sole insert portion is made from one or more layers of a composite material.

15. A golf club head comprising:

a body portion comprising a front portion, a face portion at the front portion, a rear portion, a toe portion, a heel portion, a top portion, a bottom portion, and a periphery, the bottom portion comprising:

a forward portion at or proximate the front portion;

a rear protrusion at or proximate the rear portion, the rear protrusion projecting downward from the periphery and extending longitudinally in a rear-to-front direction;

a first weight port at the forward portion and configured to receive a first weight portion;

a second weight port at the rear protrusion and configured to receive a second weight portion;

a recessed portion separating the forward portion and the rear protrusion, the recessed portion comprising:

a plurality of contoured transition regions comprising:

a first contoured transition region located adjacent or proximate to the first weight port;

a second contoured transition region extending from the first contoured transition region in a rearward diagonal direction toward the toe portion;

a third contoured transition region extending from the first contoured transition region in a rearward diagonal direction toward the heel portion;

a fourth contoured transition region extending from the second contoured transition region in a rearward direction about the periphery and adjoining the rear protrusion;

a fifth contoured transition region extending from the third contoured transition region in a rearward direction about the periphery and adjoining the rear protrusion;

an opening defined by the plurality of contoured transition regions and the rear protrusion;

and a sole insert portion coupled to the bottom portion to cover the opening, wherein an end portion of the second contoured transition region and an end portion of the third contoured transition region extend forward of the first contoured transition region to define a pocket structure with the first contoured transition region to enable the first weight port to be positioned further rearward and closer to a center portion of the bottom portion, and wherein the sole insert portion is made of a material having a lower density than a material of the body portion.

16. A golf club head as defined in claim 15, wherein the rear protrusion is wedge shaped and decreases in height and width in the rear-to-front direction.

17. A golf club head as defined in claim 15, wherein the sole insert portion defines greater than 30% and less than 40% of a total outer surface area of the bottom portion.

18. A golf club head as defined in claim 15, wherein the sole insert portion is made from one or more layers of a composite material, and wherein the sole insert portion has a thickness ranging from 0.250 mm to 1.250 mm.

19. A golf club head as defined in claim 15, wherein the sole insert portion comprises a central intermediate portion extending between the first contoured transition region and the rear protrusion, a first wing portion that increases in surface area in a rearward direction from the central intermediate portion toward a rear-toe portion of the periphery, and a second wing portion that increases in surface area in a rearward direction from the central intermediate portion toward a rear-heel portion of the periphery, wherein the fourth contoured transition region at least partially defines the rear-toe portion of the periphery, wherein the fifth contoured transition region at least partially defines the rear-heel portion of the periphery, and wherein the central intermediate portion, the first wing portion, and the second wing portion have different outer surface areas.

20. A golf club head as defined in claim 15 further comprising a shoulder portion adjoined to the plurality of contoured transition regions and the rear protrusion, the shoulder portion extending inward toward the opening, wherein the sole insert portion is coupled to the shoulder portion to cover the opening.

* * * * *